US006730633B2

(12) United States Patent
Ueno et al.

(10) Patent No.: US 6,730,633 B2
(45) Date of Patent: May 4, 2004

(54) TRANSFER SHEET FOR ADHESIVE LAYER AND USE THEREOF

(75) Inventors: Takeshi Ueno, Tokyo-To (JP); Tatsuya Kita, Tokyo-To (JP); Naoji Shibasaki, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 17 days.

(21) Appl. No.: 09/978,683

(22) Filed: Oct. 18, 2001

(65) Prior Publication Data

US 2002/0048663 A1 Apr. 25, 2002

Related U.S. Application Data

(62) Division of application No. 09/412,138, filed on Feb. 18, 1999, now Pat. No. 6,350,580, which is a division of application No. 08/682,611, filed on Nov. 14, 1996, now Pat. No. 6,040,268.

(30) Foreign Application Priority Data

Apr. 6, 1995 (JP) ..... 7-106898
Apr. 6, 1995 (JP) ..... 7-106899
Apr. 6, 1995 (JP) ..... 7-106900
Apr. 6, 1995 (JP) ..... 7-106901

(51) Int. Cl.[7] ..... B41M 5/035; B41M 5/38
(52) U.S. Cl. ..... 503/227
(58) Field of Search ..... 8/471; 428/195; 503/227

(56) References Cited

U.S. PATENT DOCUMENTS 5,372,987 A * 12/1994 Fisch et al. ..... 503/227
5,397,634 A 3/1995 Cahill et al. ..... 428/304.4
5,534,477 A * 7/1996 Nakamura et al. ..... 503/227
5,576,264 A * 11/1996 Ueno et al. ..... 503/227

FOREIGN PATENT DOCUMENTS

| | | |
|---|---|---|
| EP | 0 487 727 A1 | 6/1992 |
| GB | 2 005 598 A | 4/1979 |
| JP | 52-82508 | 7/1977 |
| JP | 64-11480 | 2/1989 |
| JP | 64-44797 | 2/1989 |
| JP | 4-78599 | 3/1992 |
| JP | 5-177994 | 7/1993 |
| JP | 5-238164 | 9/1993 |
| JP | 7-52522 | 2/1995 |
| WO | WO 86/01097 | 2/1986 |

OTHER PUBLICATIONS

Patent Abstracts of Japan, vol. 016, No. 290, Jun. 26, 1992 & JP 04 078599 A, Mar. 12, 1992.

Database WPI, Section Ch, Week 9333, Derwent Publications Ltd., London, GB; AN 93–261385 XP002112901 & JP 05 177994 A, Jul. 20, 1993 Abstract.

Database WPI, Section Ch, Week 9517, Derwent Publications Ltd., London, GB; AN 95–127952 XP002112902 & JP 07 052522 A, Feb. 28, 1995 Abstract.

* cited by examiner

*Primary Examiner*—B. Hamilton Hess
(74) *Attorney, Agent, or Firm*—Parkhurst & Wendel, L.L.P.

(57) ABSTRACT

A transfer sheet, for an adhesive layer, for use in the formation of an image by a thermal transfer process, an image forming method using the transfer sheet for an adhesive layer, and an object with an image formed thereon are disclosed. A transfer sheet 1 for an adhesive layer comprises: a substrate sheet 2; and an adhesive layer 3 and an interposing layer 4 laminated in that order on the substrate sheet 2. The substrate sheet 2 and the adhesive layer 3 are separable from each other. The use of the transfer sheet for an adhesive layer in combination with an intermediate transfer medium enables a desired image having a high quality to be efficiently formed on a particular article.

7 Claims, 14 Drawing Sheets

TRANSFER SHEET FOR ADHESIVE LAYER AND USE THEREOF

This is a division of application Ser. No. 09/412,138, filed on Feb. 18, 1999, now U.S. Pat. No. 6,350,580, which in turn is a division of application Ser. No. 08/682,611, filed on Nov. 14, 1996, now U.S. Pat. No. 6,040,268.

TECHNICAL FIELD

The present invention relates to a transfer sheet for an adhesive layer, particularly a transfer sheet, for an adhesive layer, which has a combination of excellent adhesion to a transfer material and excellent adhesion to an image-forming object or releasability of an adhesive layer from the transfer sheet for an adhesive layer, and an image-forming method and an object, with an image formed thereon, using the transfer sheet for an adhesive layer.

BACKGROUND ART

Further, the present invention relates to a transfer sheet for an adhesive layer, particularly a transfer sheet, for an adhesive layer, which can conduct temporary bonding and separation a plurality of times in bonding a transfer material to a different material through an adhesive layer transferred onto the transfer material, an image-forming method using the transfer sheet for an adhesive layer, and an object, with an image formed thereon, and, an intermediate thereof, that is, an intermediate image-forming object, formed using the transfer sheet for an adhesive layer.

A melt type thermal transfer system and a sublimation type thermal transfer system have hitherto been used extensively as a thermal transfer system. In the sublimation type thermal transfer system, a thermal transfer sheet comprising a substrate sheet, such as a plastic film, bearing a dye layer formed of a binder resin with a sublimable dye as a colorant melted or dispersed therein is used with an image-forming object comprising a support, such as paper or a plastic sheet, bearing an image-receptive layer, and energy corresponding to image information is applied by means of a heating device, such as a thermal head, to transfer a sublimable dye contained in a dye layer of the thermal transfer sheet onto an image-receptive layer of the image-forming object, thereby recording an image. According to the sublimation type thermal transfer system, the amount of the dye transferred can be regulated on a dot basis by regulating the amount of energy applied to the thermal transfer sheet, enabling tone reproduction by taking advantage of density gradation. Further, since the colorant used is a dye, the recorded image has good transparency and, at the same time, the reproduction of an intermediate color created by superposition of colors using a plurality of dye layers is excellent. Therefore, a high-quality, full-color image can be recorded by using a thermal transfer sheet(s) for three colors of yellow, magenta, and cyan or four colors of yellow, magenta, cyan, and black to superpose these three or four colors on top of one another on an object.

In the formation of an image by the sublimation type thermal transfer system, an image can be formed on image-forming materials having various shapes by once forming an image on an intermediate transfer medium having an image-receptive layer and transferring the image-receptive layer, with an image formed thereon, onto an image-forming object. The formation of an image using the intermediate transfer medium by the sublimation type thermal transfer system, however, often suffers from a drawback that the adhesion between the image-receptive layer and the image-forming object in its image-forming surface is unsatisfactory. In this case, it is preferred to transfer the image-receptive layer onto the image-forming object through an adhesive layer.

DISCLOSURE OF INVENTION

According to the present invention, a transfer sheet for an adhesive layer is used in the formation of an adhesive layer used in the above transfer of an image-receptive layer onto an image-forming object. Specifically, the transfer sheet, for an adhesive layer, according to the present invention basically comprises a substrate sheet and an adhesive layer provided on the substrate sheet. It is put on top of an image-receptive layer in an intermediate transfer medium so as for the adhesive layer to face the image-receptive layer, and, in this state, heat and pressure are applied through the substrate sheet to transfer the adhesive layer onto the image-receptive layer in the intermediate transfer medium.

The transferred adhesive layer is in direct contact with the image-receptive layer in the intermediate transfer medium. Therefore, the adhesive layer should be formed of a resin that has good adhesion to the resin constituting the image-receptive layer and into which the dye constituting the image is not bled. This greatly limits the material usable for the adhesive layer. Further, an adhesive layer, that is easily adhered to the image-receptive layer, is in many cases difficult to be adhered to an image-forming object, such as paper. In this respect as well, there is a limitation on the selection of the material. Furthermore, when the image-forming object is one having a fiber texture, such as paper, the transfer of an image-receptive layer onto an image-forming object through an adhesive layer causes the adhesive layer to be penetrated into the image-forming object, posing a problem that the fiber texture of the image-forming object appears on the surface of the formed image.

Good releasability of the adhesive layer from the substrate sheet is required of the thermal transfer sheet for an adhesive layer. If the transferred adhesive layer has a smaller thickness than a desired one or poor surface smoothness, the adhesion of the transferred image-receptive layer to an image-forming object is poor, or irregularities are created on the image-receptive layer, resulting in deteriorated image quality.

Further, when the image-receptive layer with an adhesive layer formed thereon by transfer is transferred onto an image-forming object through the adhesive layer, or when an image-receptive layer is transferred onto an image-forming object, with an adhesive layer formed thereon by transfer, through the adhesive layer, registration is necessary between the image-receptive layer and the image-forming object. In the case of an adhesive layer formed by transfer using the transfer sheet for an adhesive layer, when the image-receptive layer or the image-forming object once comes into contact with and adhered to the adhesive layer of the transfer sheet for an adhesive layer, there is a possibility that the adhesive layer cannot be separated from the sheet, making it impossible to release and again adhere the adhesive layer for more accurate registration. For this reason, registration while repeating contact and separation between the image-receptive layer and the image-forming object a plurality of times becomes impossible, imposing restriction on registration work at the time of transfer of the image-receptive layer onto the image-forming object.

In view of the above situation, the present invention has been made, and an object of the present invention is to provide a transfer sheet, for an adhesive layer, which can transfer an adhesive layer and has excellent adhesion to a transfer material (an intermediate transfer medium), is free from bleeding of dyes, has excellent adhesion to an image-forming object, and is free from penetration into the image-forming object, and an image-forming method and an object, with an image formed thereon, using said transfer sheet for an adhesive layer.

Another object of the present invention is to provide a transfer sheet, for an adhesive layer, which can transfer and form an adhesive layer, with desired thickness, possessing very good releasability and having uniform thickness and high surface smoothness.

A further object of the present invention is to provide a transfer sheet, for an adhesive layer, which is excellent in transferability and adhesion of an adhesive layer onto a transfer material and enables temporary bonding and separation to be repeated a plurality of times to achieve satisfactory positioning for bonding of a transfer material to a different object, an image-forming method, which can form a high-quality image using said transfer sheet for an adhesive layer, and an object, with an image formed thereon, and an intermediate thereof, that is, an intermediate image-forming object, formed using the transfer sheet for an adhesive layer.

The transfer sheet for an adhesive layer according to the present invention basically comprises a substrate sheet and an adhesive layer separably provided on the substrate sheet.

Further, it embraces transfer sheets, for an adhesive layer, improved for solving the above technical problems.

Thus, according to one aspect of the present invention, there is provided a transfer sheet for an adhesive layer, comprising: a substrate sheet; and an adhesive layer and an interposing layer laminated in that order on at least part of one surface of the substrate sheet, the substrate sheet and the adhesive layer being separable from each other.

According to a preferred embodiment of the present invention, the interposing layer has a glass transition point in the range of from 50 to 115° C. and the adhesive layer has a glass transition point in the range of from 35 to 100° C., the glass transition point of the interposing layer being above that of the adhesive layer; at least one of the interposing layer and the adhesive layer contains a filler; or the transfer sheet for an adhesive layer further comprises a back surface layer on the surface of the substrate sheet remote from the adhesive layer.

According to another aspect of the present invention, there is provided an image forming method comprising the steps of: forming an image on a releasable image-receptive layer in an intermediate transfer medium by a thermal sublimation transfer process; putting the intermediate transfer medium and the above transfer sheet, for an adhesive layer, on top of the other so as for the image-receptive layer to abut against the interposing layer on the intermediate transfer medium and applying heat and/or pressure to the laminate by transfer means to transfer the adhesive layer onto the image-receiving layer through the interposing layer; and putting an image-forming object onto the intermediate transfer medium so as for the image-forming object to abut against the adhesive layer and applying heat and/or pressure to the laminate by transfer means to transfer the image-receptive layer onto the image-forming object through the adhesive layer.

According to a further aspect of the present invention, there is provided an object with an image formed thereon, comprising: an image-forming object; an adhesive layer and an interposing layer laminated in that order on a desired site of the image-receiving object; and an image-receptive layer provided on the interposing layer, the image-receptive layer having an image formed by a thermal sublimation transfer process.

According to a preferred embodiment of the present invention, in the object with an image formed thereon, the interposing layer has a glass transition point in the range of from 50 to 115° C. and the adhesive layer has a glass transition point in the range of from 35 to 100° C., the glass transition point of the interposing layer being above that of the adhesive layer; or at least one of the interposing layer and the adhesive layer contains a filler.

The adhesive layer provided on the substrate sheet has thereon an interposing layer which has good adhesion to a transfer material, onto which the adhesive layer is to be transferred, and, at the same time, can prevent bleeding of dyes. Therefore, the transfer of the adhesive layer onto a transfer material is very good, and, for the adhesive layer, importance can be placed on the adhesion to the image-forming object and properties which enable prevention of penetration of the adhesive layer, thus realizing a transfer sheet, for an adhesive layer, which can develop good transfer onto a transfer material by virtue of the interposing layer and good transfer onto an image-forming object by virtue of the adhesive layer.

According to a further aspect of the present invention, there is provided a transfer sheet for an adhesive layer, comprising: a substrate sheet; and a peel layer and an adhesive layer laminated in that order on at least part of one surface of the substrate sheet, the substrate sheet and the peel layer being separable from each other, the glass transition point of the peel layer being above that of the adhesive layer.

In a preferred embodiment of the present invention, the peel layer has a glass transition point in the range of from 50 to 115° C. and the adhesive layer has a glass transition point in the range of from 35 to 100° C.; at least one of the peel layer and the adhesive layer contains a filler; or the transfer sheet for an adhesive layer further comprises a back surface layer on the surface of the substrate sheet remote from the adhesive layer.

According to a yet further aspect of the present invention, there is provided an image-forming method comprising the steps of: forming an image on a releasable image-receptive layer in an intermediate transfer medium by a thermal sublimation transfer process; putting an image-forming object and a transfer sheet for an adhesive layer according to any one of the above thermal transfer sheets, for an adhesive layer, on top of the other so as for the adhesive layer of the transfer sheet for an adhesive layer to abut against the image-forming object and applying heat and/or pressure to the laminate by transfer means to transfer the adhesive layer, together with the peel layer, onto the image-forming object; and putting the image-forming object and the intermediate transfer medium on top of the other so as for the peel layer to abut against the image-receptive layer and applying heat and/or pressure to the laminate by transfer means to transfer the image-receptive layer onto the image-forming object through the peel layer and the adhesive layer.

According to a yet further aspect of the present invention, there is provided an object with an image formed thereon, comprising: an image-forming object; an adhesive layer and a peel layer laminated in that order on a desired site of the image-forming object, the glass transition point of the peel layer being above that of the adhesive layer; and an image-receptive layer provided on the peel layer, the image-receptive layer having thereon an image formed by a thermal sublimation transfer process.

According to a preferred embodiment of the present invention, the peel layer has a glass transition point in the range of from 50 to 115° C. and the adhesive layer has a glass transition point in the range of from 35 to 70° C.; or at least one of the peel layer and the adhesive layer contains a filler.

In the object with an image formed thereon, an adhesive layer is provided on a substrate sheet through a peel layer, and the peel layer has a glass transition point above the adhesive layer. By virtue of this construction, in the transfer of the adhesive layer, good separation occurs between the substrate sheet and the peel layer, eliminating the need for the adhesive layer to have releasability from the substrate sheet. This enables the adhesive layer to have high adhesion to a transfer material. Further, since the peel layer is located on the surface of the transferred adhesive layer, good surface properties can be maintained even though the adhesive layer penetrates into the transfer material.

According to a yet further aspect of the present invention, there is provided a transfer sheet for an adhesive layer, comprising: a substrate sheet; and a release layer and an adhesive layer laminated in that order on at least part of one surface of the substrate sheet, the release layer and the adhesive layer being separable from each other.

In a preferred embodiment of the present invention, the release layer contains a release agent; the release agent is a silicone compound; the adhesive layer is a laminate of two or more adhesive layers; and/or the thermal transfer sheet further comprises a back surface layer on the surface of the substrate sheet remote from the adhesive layer.

The adhesive layer is provided on the substrate sheet through a release layer. The release layer functions to suitably hold the adhesive layer and, at the same time, exhibits good releasability from the adhesive layer at the time of transfer without deteriorating the adhesive property of the adhesive layer, resulting in transfer of the adhesive layer in uniform thickness without leaving any residue of the adhesive layer on the substrate sheet side.

According to a yet further aspect of the present invention, there is provided a transfer sheet for an adhesive layer, comprising: a substrate sheet; and a releasable adhesive layer having low tackiness provided on at least part of one surface of the substrate sheet.

In a preferred embodiment of the present invention, the transfer sheet for an adhesive layer further comprises an interposing layer on the adhesive layer; at least one of the adhesive layer and the interposing layer contains a filler; a peel layer is provided between the substrate sheet and the adhesive layer, the peel layer and the substrate sheet being separable from each other; the glass transition point of the peel layer is above that of the adhesive layer; or the transfer sheet for an adhesive layer further comprises a back surface layer on the surface of the substrate sheet remote from the adhesive layer.

According to a yet further aspect of the present invention, there is provided an image forming method comprising the steps of: forming an image on a releasable image-receptive layer in an intermediate transfer medium by a thermal sublimation transfer process; putting the intermediate transfer medium and a transfer sheet for an adhesive layer according to any one of the transfer sheets, for an adhesive layer, on top of the other so as for the image-receptive layer to abut against the adhesive layer or the interposing layer of the transfer sheet for an adhesive layer and applying heat and/or pressure to the laminate by transfer means to transfer the adhesive layer onto the image-receptive layer; putting the intermediate transfer medium and an image-forming object on top of the other for registration by taking advantage of the low tackiness of the adhesive layer present on the intermediate transfer medium; and transferring the image-receptive layer onto the image-forming object through the adhesive layer.

According to a yet further aspect of the present invention, there is provided an image forming method comprising the steps of: forming an image on a releasable image-receptive layer in an intermediate transfer medium by a thermal sublimation transfer process; putting an image-forming object and a transfer sheet for an adhesive layer according to any one of the above transfer sheets, for an adhesive layer, on top of the other so as for the image-forming object to abut against the adhesive layer of the transfer sheet for an adhesive layer and applying heat and/or pressure to the laminate by transfer means to transfer the adhesive layer onto the image-forming object; putting the image-forming object and the intermediate transfer medium on top of the other for registration by taking advantage of the low tackiness of the adhesive layer present on the image-forming object; and transferring the image-receptive layer onto the image-forming object through the adhesive layer.

According to a yet further aspect of the present invention, there is provided an intermediate image-forming object, comprising an intermediate transfer medium having a releasable image-receptive layer; an image formed on the image-receptive layer by a thermal sublimation transfer process; and an adhesive layer having low tackiness provided on at least an image-formed area of the image-receptive layer. In a preferred embodiment of the present invention, the intermediate image-forming object further comprises an interposing layer between the image-receptive layer and the adhesive layer; or at least one of the adhesive layer and the interposing layer contains a filler.

According to a yet further aspect of the present invention, there is provided an intermediate image-forming object, comprising: an image-forming object; and an adhesive layer, having low tackiness, provided on a desired area of the image-forming object. In a preferred embodiment of the intermediate image-forming object according to the present invention, the intermediate image-forming object further comprises a peel layer on the adhesive layer, the glass transition point of the peel layer being above that of the adhesive layer.

According to a yet further aspect of the present invention, there is provided an object with an image formed thereon, comprising: an image-forming object; an adhesive layer provided on a desired area of the image-forming object; and an image-receptive layer provided on the adhesive layer, the image-receptive layer having an image formed by a thermal sublimation transfer process.

In a preferred embodiment of the object with an image formed thereon according to the present invention, the object with an image formed thereon further comprises an interposing layer between the image-receptive layer and the adhesive layer; or at least one of the adhesive layer and the interposing layer contains a filler.

According to another preferred embodiment of the object with an image formed thereon according to the present invention, the object with an image formed thereon further comprises a peel layer between the image-receptive layer and the adhesive layer, the glass transition point of the peel layer being above that of the adhesive layer.

Since the adhesive layer provided on the substrate sheet has low tackiness, the adhesive layer transferred onto the transfer material also has low tackiness. By virtue of the above construction, in the case of the transfer of the transfer material onto a different object through the adhesive layer, after the adhesive layer is once brought into contact with a different object, it can be released from and re-adhered to the object. Further, the interposing layer formed on the adhesive layer has good adhesion to a transfer material (for example, an intermediate transfer medium provided with an image-receptive layer), onto which an adhesive layer is to be transferred, and, at the same time, can function to prevent bleeding of dyes. Therefore, the transfer of the adhesive layer onto a transfer material is very good, and the peel layer formed between the substrate sheet and the adhesive layer is satisfactorily separated from the substrate sheet and located on the surface of the transferred adhesive layer, enabling good surface properties to be maintained even though the adhesive layer penetrates into an object (for example, an image-forming object such as paper). Thus, after the adhesive layer is transferred onto an intermediate transfer medium as a transfer material or an image-forming object, registration between the intermediate transfer object and the image-forming object can be easily performed by taking advantage of low tackiness of the adhesive layer.

Meaning of the above terms will be described. In the present invention, the term "adhesive layer" refers to a layer for imparting adhesion mainly to an image-forming object. Both the terms "interposing layer" and "peel layer" refer to a layer which functions as a second adhesive layer because both layers impart adhesion to the intermediate transfer medium. However, it should be noted that the "interposing layer" on the transfer sheet for an adhesive layer, together with the "adhesive layer," is transferred onto the receptive layer of the intermediate transfer medium. On the other hand, the "peel layer," together with the adhesive layer, is transferred onto the image-forming object before the receptive layer is transferred. Therefore, it should be noted that the "interposing layer" and the "peel layer" are different from each other in object onto which the layer is transferred. In this sense, these words each are used in its proper way.

BEST MODE FOR CARRYING OUT THE INVENTION

First Aspect of Invention

Figure 1:
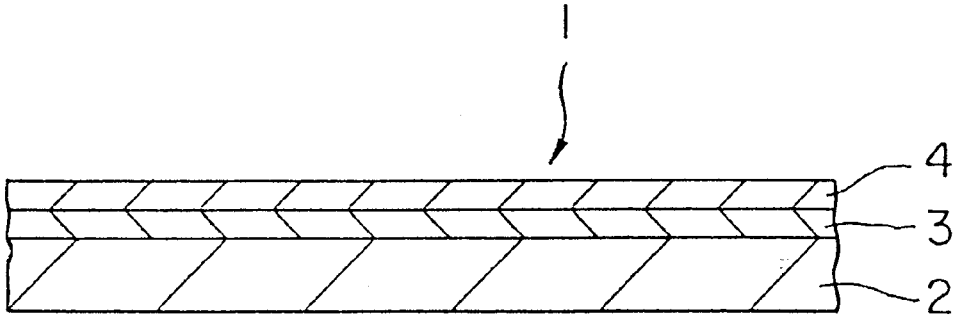
FIGS. 1, 2, 5, 6, 7, 10, 11, 12, 13, 14, 15, 16, 17, 22, and 23 are schematic cross-sectional views showing embodiments of the transfer sheet for an adhesive layer according to the present invention.

FIG. 1 is a schematic cross-sectional view showing an embodiment of the transfer sheet, for an adhesive layer, according to the first aspect of the present invention. In FIG. 1, a transfer sheet 1 for an adhesive layer comprises a substrate sheet 2, an adhesive layer 3 separably provided on the substrate sheet 2, and an interposing layer 4 provided on the adhesive layer 3. The transfer sheet 1 for an adhesive layer according to the present invention is characterized in that the interposing layer 4 is further provided on the adhesive layer 3 separably provided on the substrate sheet 2.

By virtue of the above construction of the transfer sheet 1 for an adhesive layer according to the present invention, good adhesion to a transfer material and a capability of preventing bleeding of dyes can be imparted to the interposing layer 4, the adhesive layer 3 can be transferred to a transfer material (an intermediate transfer medium) through the interposing layer 4, and, at the same time, after transfer to an image-forming object, has good adhesion to the image-forming object and a capability of preventing penetration into the image-forming object. Thus, various properties required of the adhesive layer of the conventional transfer sheet for an adhesive layer can be shared by the adhesive layer 3 and the interposing layer 4. Therefore, even though the adhesive layer 3 penetrates into the image-forming object, the presence of the interposing layer 4 prevents the surface state of the image-forming object from appearing on the surface of the image. This increases the degree of freedom for the selection of material for the adhesive layer 3 (not to mention the degree of freedom of material for the interposing layer 4), realizing a transfer sheet, for an adhesive layer, which can stably develop various required properties.

Preferably, the adhesive layer 3 constituting the transfer sheet for an adhesive layer is formed of a material that develops adhesion upon heating, for example, a thermoplastic synthetic resin, natural resin, rubber, or wax. More specific examples of the material usable for constituting the adhesive layer 3 include synthetic resins, for example, cellulose derivatives, such as ethyl cellulose and cellulose acetate propionate, styrene resins, such as polystyrene and poly-α-methylstyrene, acrylic resins, such as polymethyl methacrylate and polyethyl acrylate, vinyl resins, such as polyvinyl chloride, polyvinyl acetate, vinyl chloride/vinyl acetate copolymer, polyvinyl butyral, and polyvinyl acetal, polyester resins, polyamide resins, epoxy resins, polyurethane resins, ionomers, ethylene/acrylic acid copolymer, and ethylene/acrylic ester copolymer; and natural resins and derivatives of synthetic rubbers, usable as a tackifier, such as rosin, rosin-modified maleic acid resins, ester gums, polyisobutylene rubber, butyl rubber, styrene/butadiene rubber, butadiene/acrylonitrile rubber, polyamide resins, and polychlorinated polyolefins.

The adhesive layer 3 may be formed of a composition comprising one or more materials described above. The thickness thereof can be determined by taking into consideration the necessary adhesive property and the processability. In general, however, it is preferably about 0.1 to 200 $\mu$m.

The interposing layer 4 provided on the adhesive layer 3 comes into direct contact with a dye image formed on the image-receptive layer of the transfer material (intermediate transfer medium) and, hence, is formed of a resin into which a dye is not bled. For this reason, preferably, a resin commonly used for constituting a dye-receptive layer in the art is employed as a resin for constituting the interposing layer.

When paper is used as the image-forming object, the adhesive layer 3 often penetrates into paper. In this case, when the interposing layer 4 is formed of a resin having a high glass transition point, it does not penetrate into paper, preventing paper texture from appearing on the surface of the interposing layer 4.

Therefore, preferably, the resin for constituting the interposing layer 4 has a glass transition point above that of the resin for constituting the adhesive layer 3. For example, a resin having a glass transition point of 50 to 115° C., preferably 60 to 90° C., may be used for constituting the interposing layer 4, with a resin having a glass transition point of 35 to 100° C., preferably 35 to 70° C., more preferably 45 to 65° C., being used for constituting the adhesive layer 3.

Specific examples of resins usable for the interposing layer 4 include vinyl chloride resin, vinyl chloride/vinyl acetate copolymer, polyester resin, polyvinyl acetal, and polymethyl methacrylate.

Preferred examples of combinations of the resin for constituting the adhesive layer 3 with the resin for constituting the interposing layer 4 are as follows.

(Adhesive layer 3) (Interposing layer 4)

polyamide resin/vinyl chloride-vinyl acetate copolymer
polyethyl acrylate/polyester resin
polyvinyl butyral/polyvinyl acetal
ethylene-acrylic acid copolymer/polymethyl methacrylate
polychlorinated polyolefin/polyvinyl chloride The thickness of the interposing layer 4 can be determined by taking into consideration necessary properties, for example, adhesion to a transfer material (an intermediate transfer medium) and a capability of preventing bleeding of dyes, processability and the like. In general, however, it is preferably about 0.1 to 200 $\mu$m.

In the present invention, a filler is preferably added to the adhesive layer 3 and the interposing layer 4 from the viewpoint of improving the transferability. In this case, conventional organic or inorganic fillers may be used. Examples of fillers usable herein include organic fillers, such as acrylic, nylon, and teflon fillers and polyethylene wax, and inorganic fillers, such as fine particles of various metal oxides including titanium oxide, zinc oxide, kaolin clay, calcium carbonate, finely divided silica, zinc oxide, and tin oxide.

The particle diameter of the filler is preferably in the range of from 0.05 to 10 $\mu$m, and the amount of the filler added is preferably in the range of from 10 to 300 parts by weight based on 100 parts by weight of the resin for constituting the adhesive layer 3 or the interposing layer 4.

The substrate sheet 2 constituting the transfer sheet 1 for an adhesive layer may be any substrate sheet commonly used in the conventional transfer sheet for an adhesive layer. Examples of preferred substrate sheets usable herein include thin papers, such as glassine, capacitor, and paraffin papers; stretched or unstretched plastic films of polyesters having high heat resistance, such as polyethylene terephthalate, polyethylene naphthalate, polybutylene terephthalate, polyphenylene sulfide, polyether ketone, and polyether sulfone, polypropylene, polycarbonate, cellulose acetate, polyethylene derivatives, polyvinyl chloride, polyvinylidene chloride, polystyrene, polyamide, polyimide, polymethylpentene, and ionomers; and laminates of the above sheets. The thickness of the substrate sheet 2 may be properly selected, depending upon the material, so as to provide proper properties such as strength and heat resistance. In general, however, it is preferably about 1 to 100 $\mu$m.

In the thermal transfer sheet for an adhesive layer according to the present invention, a release layer may be provided between the substrate sheet and the adhesive layer. In this case, the release layer may be formed of a resin, examples of which include: thermoplastic resins, for example, acrylic resins, such as polymethyl methacrylate, polyethyl methacrylate, and polybutyl methacrylate, vinyl resins, such as polyvinyl acetate, vinyl chloride/vinyl acetate copolymer, polyvinyl alcohol, polyvinyl butyral, and polyvinyl acetal, cellulose derivatives, such as ethyl cellulose, nitrocellulose, and cellulose acetate; and thermosetting resins, for example, unsaturated polyester resins, polyester resins, polyurethane resins, and aminoalkyd resins.

When no satisfactory release effect can be attained by the sole use of the thermoplastic resin, it is preferred to add a release agent to the release layer. Release agents usable herein include silicone compounds, wax, melamine resin, fluororesin, talc, finely divided silica, and lubricants, such as surfactants and metal soaps. Among them, silicone compounds are particularly preferred. Specific examples of silicone compounds include silicone oils, such as dimethyl silicone, epoxy-modified silicone, reactive silicone, alkyl-modified silicone, and amino-modified silicone oils, reaction products of a polyester resin or an epoxy resin with a silane coupling agent, silicone rubbers, silicone compounds, and silicone waxes. The addition of the above release agent to the adhesive layer 3 can improve the release effect. This, however, deteriorates the adhesive property of the adhesive layer 3 when the adhesive layer 3 and paper are adhered to each other. Therefore, as described above, the addition of the release agent to the release layer is preferred.

The above release layer can be formed by coating a coating liquid comprising a binder resin or a coating liquid comprising a binder resin, with a release agent incorporated therein, onto a substrate sheet 2 by a conventional method such as gravure printing, screen printing, or reverse roll coating using a gravure plate, and the thickness thereof is preferably about 0.05 to 5 $\mu$m.

Figure 2:
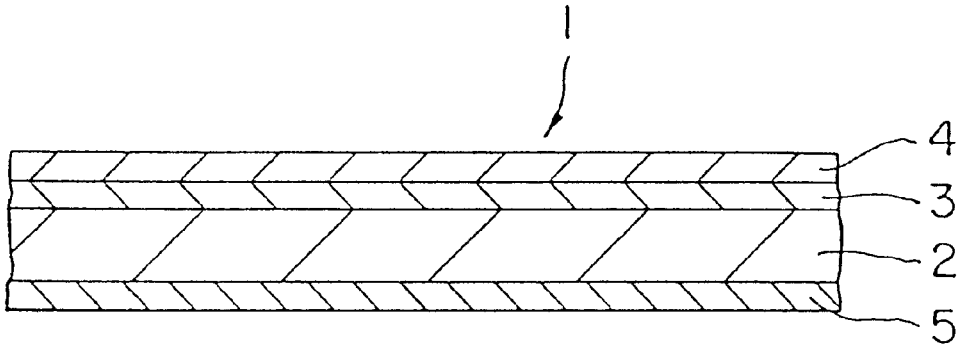

As shown in FIG. 2, the transfer sheet for an adhesive layer according to the present invention may comprise: a substrate sheet 2; an adhesive layer 3 and an interposing layer 4 provided on one surface of the substrate sheet 2; and a back surface layer 5 provided on the other surface of the substrate sheet 2. The back surface layer 5 is provided on the substrate sheet 2 for the purpose of preventing the substrate sheet 2 from being heat-fused to a heating device, such as a thermal head, at the time of transfer of the adhesive layer 3 and the interposing layer 4 onto a transfer material, enabling the transfer sheet to be smoothly carried. Examples of resins usable for the back surface layer 5 include natural or synthetic resins, for examples, cellulosic resins, such as ethyl cellulose, hydroxy cellulose, hydroxypropyl cellulose, methyl cellulose, cellulose acetate, cellulose acetate butyrate, and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile/styrene copolymer, polyamide resins, polyvinyltoluene resins, coumarone/indene resins, polyester resins, polyurethane resins, and silicone-modified or fluorine-modified urethanes. They may be used alone or as a mixture of two or more. In order to enhance the heat resistance of the back surface layer, preferably, a resin, having a hydroxyl reactive group, among the above resins is used in combination with a crosslinking agent, such as polyisocyanate, to form a crosslinked resin layer.

Further, in order to render the thermal sheet slidable on a thermal head, a solid or liquid release agent or lubricant is added to the back surface layer so that the transfer sheet have a thermal slip property. Release agents or lubricants usable herein include, for example, various waxes, such as polyethylene and paraffin waxes, higher aliphatic alcohols, organopolysiloxanes, anionic surfactants, cationic surfactants, amphoteric surfactants, nonionic surfactants, fluorosurfactants, organic carboxylic acids and derivatives thereof, fluororesins, silicone resin, and fine particles of inorganic compounds, such as talc and silica. The content of the lubricant in the back surface layer 5 is about 5 to 50% by weight, preferably about 10 to 30% by weight.

The thickness of the back surface layer 5 may be about 0.1 to 10 $\mu$m, preferably about 0.5 to 5 $\mu$m.

One embodiment of the image-forming method using a transfer sheet for an adhesive layer according to the present invention will be described with reference to FIGS. 3 and 4.

Figure 3A:
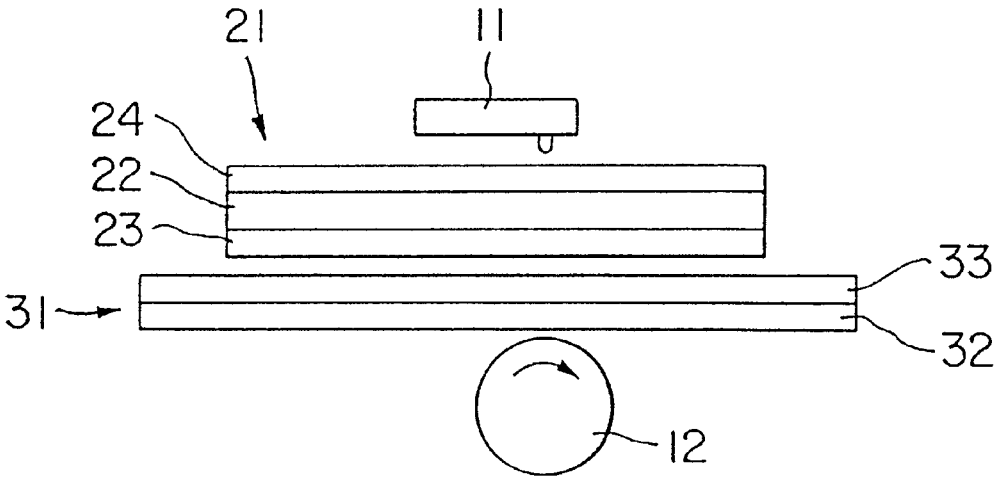
FIGS. 3A to 3C, FIGS. 4A to 4C, FIGS. 8A to 8C, FIGS. 9A to 9C, FIGS. 18A to 18C, FIGS. 19A to 19C, FIGS. 20A to 20C, and FIGS. 21A to 21C are cross-sectional views showing embodiments of the image-forming method according to the present invention.
Figure 3B:
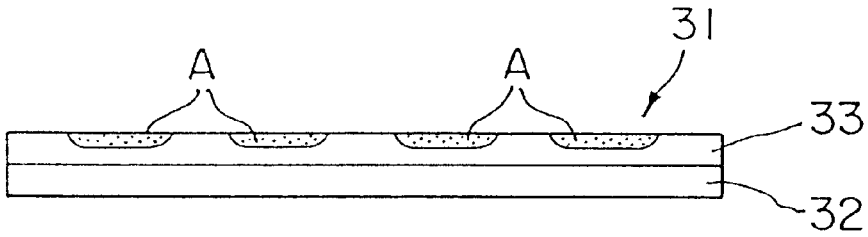

At the outset, an intermediate transfer medium 31 is put on top of a sublimation type thermal transfer sheet 21 so that a dye layer 23 in the thermal transfer sheet 21 comes into contact with an image-receptive layer 33 in the intermediate transfer medium 31. In this state, the intermediate transfer medium 31 and the thermal transfer sheet 21 are passed through between a thermal head 11 and a platen roller 12 and brought into press-contact with each other by means of the thermal head 11 and the platen roller 12. In this case, the thermal head 11 is heated according to image data (FIG. 3A). Thus, a sublimable dye contained in the dye layer 23 is transferred onto the image-receptive layer 33 in the intermediate transfer medium 31 to form an image A (FIG. 3B). In the embodiment shown in the drawings, the thermal transfer sheet 21 comprises a substrate sheet 22, a dye layer 23 provided on one surface of the substrate sheet 22, and a back surface layer 24 on the other surface of the substrate sheet 22. On the other hand, the intermediate transfer medium 31 comprises a substrate sheet 32 bearing an image-receptive layer 33.

Figure 3C:
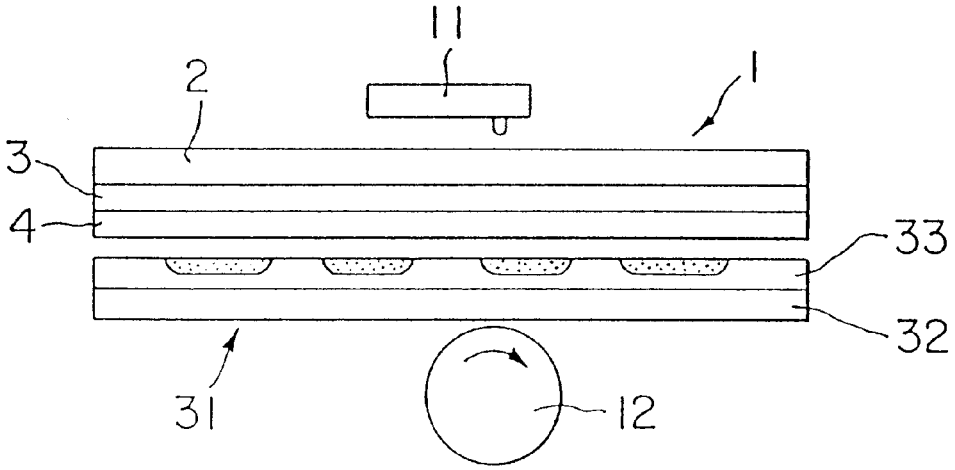
Figure 4A:
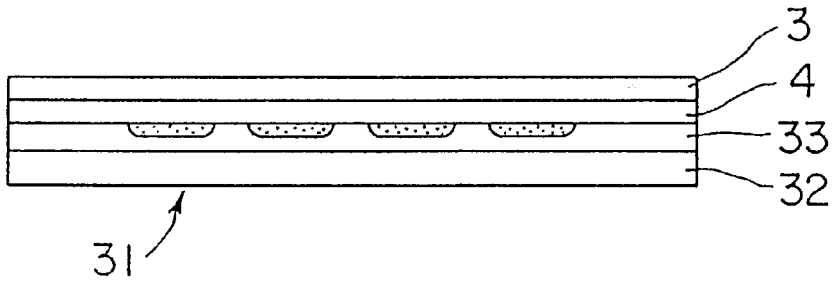

Then, a thermal transfer sheet 1 for an adhesive layer is put on top of the intermediate transfer medium 31 with the image A formed thereon so that an interposing layer 4 in the transfer sheet 1 for an adhesive layer comes into contact with the image-receptive layer 33 in the intermediate transfer medium 31 with the image A formed thereon. In this state, the intermediate transfer sheet 31 with the image A formed thereon and the transfer sheet 1 for an adhesive layer are passed through between the thermal head 11 and the platen roller 12 and brought into press-contact with each other by means of the thermal head 11 and the platen roller 12, and the thermal head 11 is heated (FIG. 3C). This causes separation between the substrate sheet 2 and the adhesive layer 3, resulting in transfer of the adhesive layer 3 onto the image-receptive layer 33 in the intermediate transfer medium 31 as a transfer object through the interposing layer 4 (FIG. 4A). As described above, in the transfer of the adhesive layer 3, the interposing layer 4 has good adhesion to the image-receptive layer 33 and a capability of preventing bleeding of dyes, and, hence, there is no need to impart such properties to the adhesive layer 3.

Figure 4B:
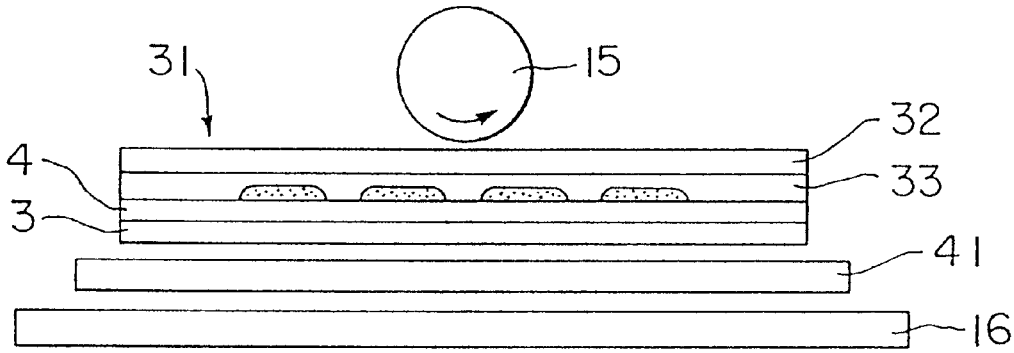
Figure 4C:
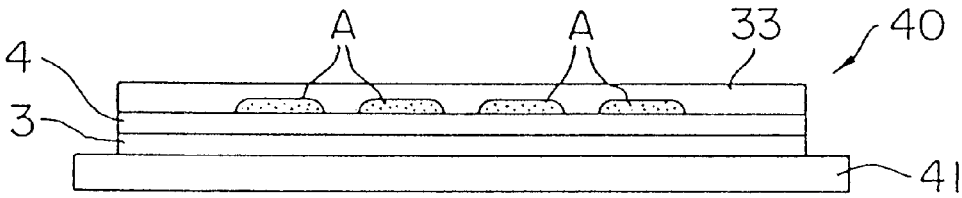

Then, the intermediate transfer medium 31 is put on top of an image-forming object 41 so that the adhesive layer 3 in the intermediate transfer medium 31 faces the image-forming object 41, and heat and pressure are applied to the laminate by means of the heat roller 15 and the platen 16 (FIG. 4B). This result in the transfer of the image-receptive layer 33 in the intermediate transfer medium 31 onto the image-forming object 41 to transfer and form the image A on the image-forming object 41 through the adhesive layer 3, thereby preparing an object 40 with an image formed thereon according to the present invention (FIG. 4C). Thus, the object 40 with an image formed thereon has such a construction that the adhesive layer 3 and the interposing layer 4 are laminated in that order on a desired site of the image-forming object 41, and the image-receptive layer 33 with the image A formed thereon is provided on the interposing layer 4.

In the transfer of the image-receptive layer 33 onto the image-forming object 41, the adhesion of the adhesive layer 3 to the image-forming object 41 is so good that the adhesion of the image-receptive layer 33 to the image-forming object 41 is very good. Further, even though the adhesive layer 3 penetrates into the image-forming object 41, there is no fear of the image quality being deteriorated by appearance of the surface state of the image-forming object 41 on the image A because, as described above, the interposing layer 4 has a capability of preventing penetration and the like.

There is a mirror image relationship between the image A formed on the image-forming object 41 and the image A formed on the image-receptive layer 33 in the intermediate transfer medium 31. Therefore, regarding an image, a letter, or a mark, a reverse image should be previously formed.

The above intermediate transfer medium 31 used in the image-forming method according to the present invention comprises a substrate sheet 32 and an image-receptive layer 33 provided on the substrate sheet 32. A peelable protective layer may be provided between the substrate sheet 32 and the image-receptive layer 33. The peelable protective layer may be formed in the same manner as described above in connection with the formation of the peel layer of the transfer sheet for an adhesive layer according to the present invention. The thickness of the peelable protective layer may be, for example, about 2 to 3 $g/m^2$ on a dry basis. When such a peelable protective layer is provided, in the transfer of the image-receptive layer 33, the peelable protective layer is transferred together with the image-receptive layer 33 and, after transfer, functions as a layer for protecting the image-receptive layer 33.

Figure 5:
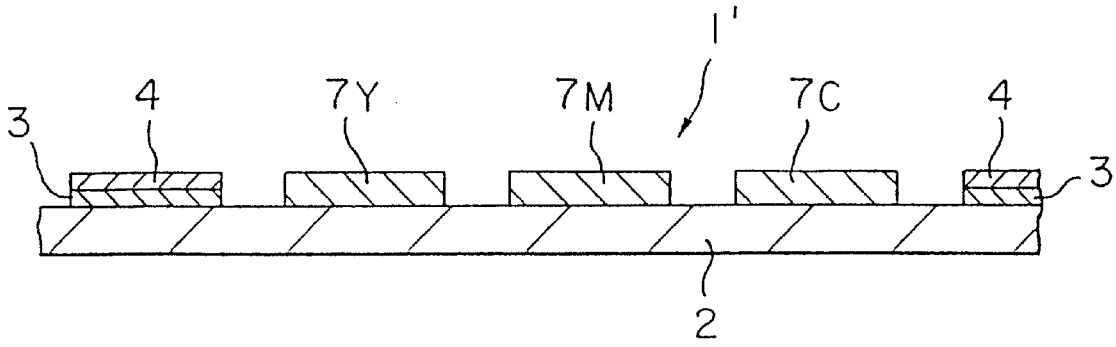

In all the above embodiments of the transfer sheet according to the present invention, an adhesive layer and an interposing layer are provided on substantially the whole area of one surface of the substrate sheet. The transfer sheet for an adhesive layer according to the present invention is not limited to these embodiments only. For example, as shown in FIG. 5, a laminate of an adhesive layer 3 and an interposing layer 4, a dye layer 7Y, a dye layer 7M, and a dye layer 7C are formed in a face serial manner on a substrate sheet 2 to constitute a transfer sheet for an adhesive layer (a thermal transfer sheet integral with an adhesive layer) 1'. The use of the thermal transfer sheet 1' integral with an adhesive layer is advantageous in that, in the above image formation, an image is formed on the image-receptive layer in the intermediate transfer medium by the transfer of the dye layer and the thermal head for the formation of an image as such may be used to continuously transfer and form an adhesive layer on the image-receptive layer.

Second Aspect of Invention

Figure 6:
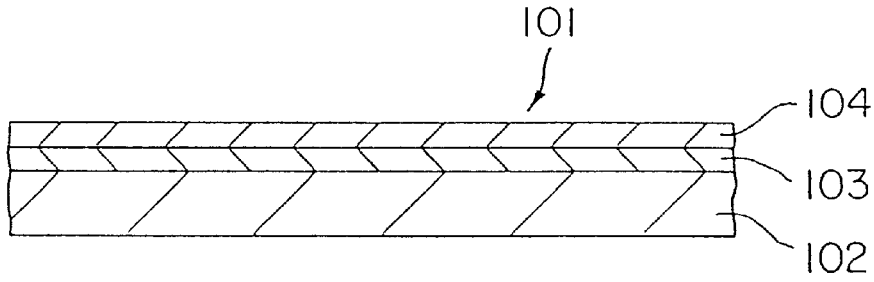

FIG. 6 is a schematic cross-sectional view showing an embodiment of the transfer sheet, for an adhesive layer, according to the second aspect of the present invention. In FIG. 6, a transfer sheet 101 for an adhesive layer comprises a substrate sheet 102 and an adhesive layer 104 provided on the substrate sheet 102 through a peel layer 103. The transfer sheet 101 for an adhesive layer according to the present invention is characterized in that a peel layer 103 is provided between the substrate sheet 102 and the adhesive layer 104, the glass transition point of the peel layer 103 being above that of the adhesive layer 104.

Further, the peel layer 103 constituting the transfer sheet 101 for an adhesive layer contains a resin having a glass transition point above that of the adhesive layer 104. The resin for constituting the peel layer 103 may be selected from resins having a glass transition point in the range of from 50 to 115° C., preferably in the range of from 60 to 90° C. Specific examples of such resins include vinyl chloride resin, vinyl chloride/vinyl acetate copolymer, polyester resin, polyvinyl acetal, and polymethyl methacrylate. They may be used alone or in combination of two or more.

Preferred examples of combinations of the resin for constituting the peel layer 103 with the resin for constituting the adhesive layer 104 are as follows.

(Peel layer 103) (Adhesive layer 104)

vinyl chloride-vinyl acetate copolymer/polyamide resin
polyester resin/polyethyl acrylate
polyvinyl acetal/polyvinyl butyral
polymethyl methacrylate/ethylene-acrylic acid copolymer
polyvinyl chloride/polychlorinated polyolefin The peel layer 103 can be formed by coating a resin coating liquid onto a substrate sheet 2 by a conventional method such as gravure printing, screen printing, or reverse roll coating using a gravure plate, and the thickness thereof is preferably 0.5 to 20 $\mu$m.

The adhesive layer 104 constituting the transfer sheet 101 for an adhesive layer has a glass transition point below that of the peel layer 103 and may be the same as that described in the embodiments according to the first aspect of the present invention.

In the present invention, a filler is preferably added to the peel layer 103 and the adhesive layer 104 from the viewpoint of improving the transferability. In this case, the type, particle diameter, and mixing ratio of the filler used may be the same as those of the filler used in the adhesive layer and the interposing layer described above in the embodiments of the first aspect of the present invention.

Further, the incorporation of a release agent into the peel layer 103 improves the releasability from the substrate sheet 102, enabling the transfer to be performed without causing dropout and missing. Release agents usable herein include silicone compounds, wax, melamine resin, fluororesin, talc, finely divided silica, and lubricants, such as surfactants and metal soaps. Among them, silicone compounds are particularly preferred.

Figure 7:
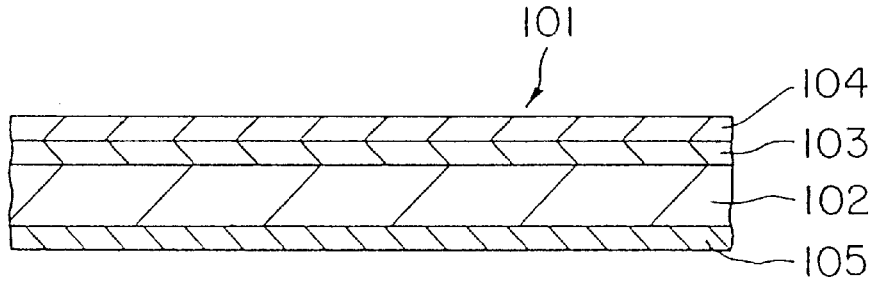

As shown in FIG. 7, the transfer sheet for an adhesive layer according to the present invention may comprise a substrate 102, a peel layer 103 and an adhesive layer 104 provided on one surface of the substrate sheet 102, and a back surface layer 105, of the same type as described above in connection with the embodiments of the first aspect of the present invention, on the other surface of the substrate sheet 102.

One embodiment of the image-forming method using a transfer sheet for an adhesive layer according to the present invention will be described with reference to FIGS. 8 and 9.

Figure 8A:
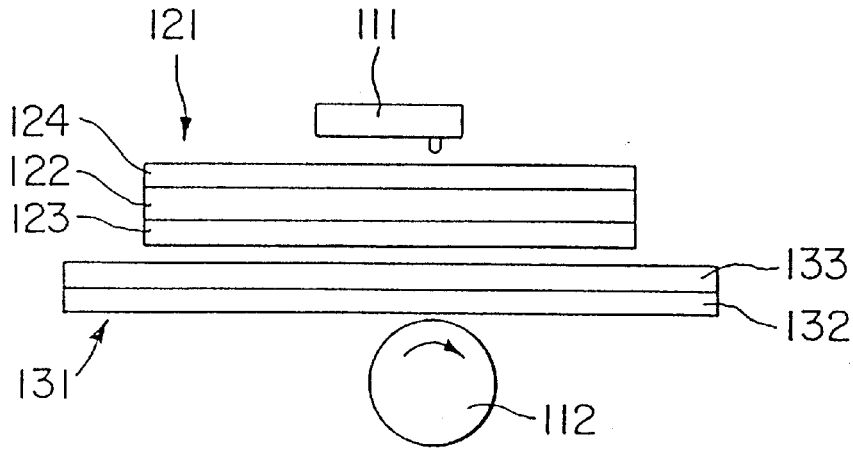
Figure 8B:
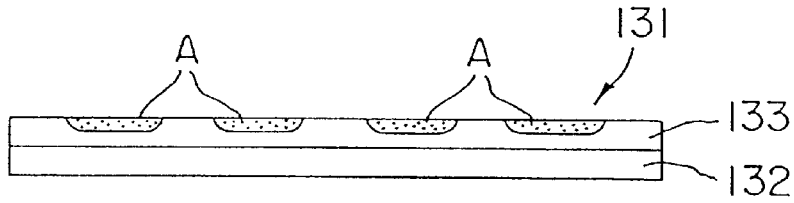

At the outset, an intermediate transfer medium 131 is put on top of a sublimation type thermal transfer sheet 121 so that a dye layer 123 in the thermal transfer sheet 121 comes into contact with an image-receptive layer 133 in the intermediate transfer medium 131. In this state, the intermediate transfer medium 131 and the thermal transfer sheet 121 are passed through between a thermal head 111 and a platen roller 112 and brought into press-contact with each other by means of the thermal head 111 and the platen roller 112. In this case, the thermal head 111 is heated according to image data (FIG. 8A). Thus, a sublimable dye contained in the dye layer 123 is transferred onto the image-receptive layer 133 in the intermediate transfer medium 131 to form an image A (FIG. 8B). In the embodiment shown in the drawings, the thermal transfer sheet 121 comprises a substrate sheet 122, a dye layer 123 provided on one surface of the substrate sheet 122, and a back surface layer 124 on the other surface of the substrate sheet 122. On the other hand, the intermediate transfer medium 131 comprises a substrate sheet 132 bearing an image-receptive layer 133.

Figure 8C:
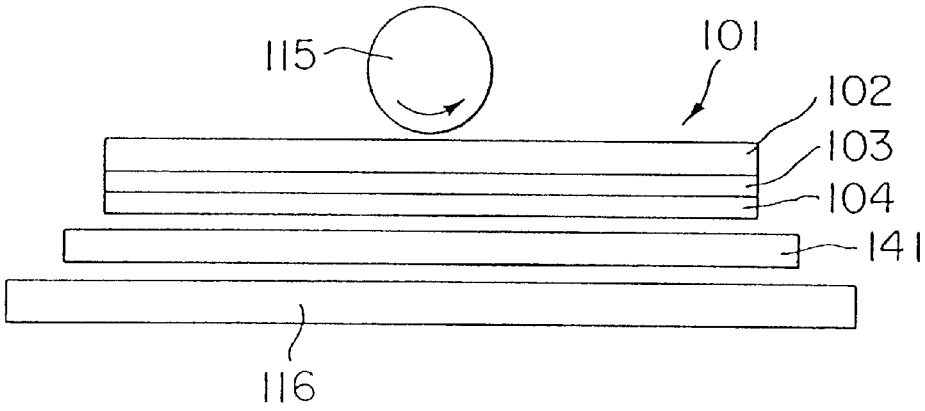
Figure 9A:
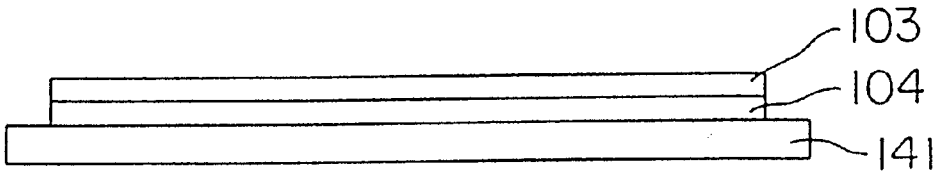

Then, the transfer sheet 101 for an adhesive layer is put on top of the image-forming object 141 as an object, onto which an image is to be transferred, so that the adhesive layer 104 in the transfer sheet 101 for an adhesive layer comes into contact with the image-forming object 141. Heat and pressure are applied to the laminate by means of a heat roller 115 and a platen 116 (FIG. 8C). By this operation, separation occurs between the substrate sheet 102 in the transfer sheet 101 for an adhesive layer and the peel layer 103, and the adhesive layer 104, together with the peel layer 103, is transferred onto the image-forming object 141 (FIG. 9A).

Figure 9B:
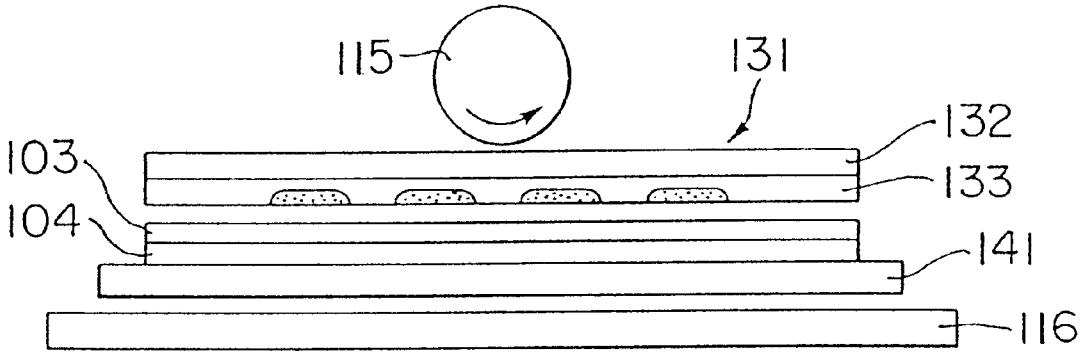
Figure 9C:
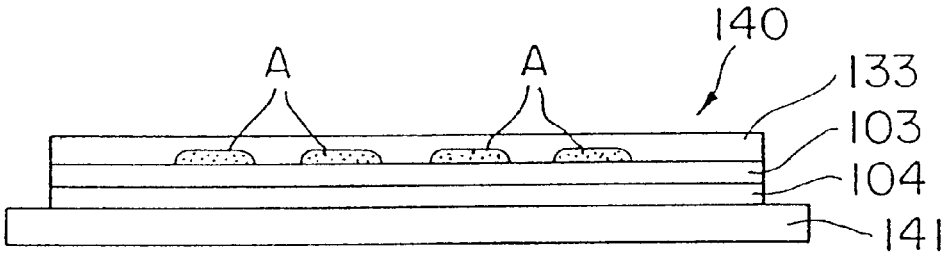

Then, the image receptive layer 133 in the intermediate transfer medium 131 with the image A formed thereon is put on top of the peel layer 103 provided on the image-forming object 141, and heat and pressure are applied to the laminate by means of the heat roll 115 and the platen 116 (FIG. 9B). This results in the transfer of the image-receptive layer 133 in the intermediate transfer medium 131 onto the image-forming object 141 through the peel layer 103 and the adhesive layer 104 to transfer and form the image A on the image-forming object 141, thereby preparing an object 140 with an image formed thereon according to the present invention (FIG. 9C).

There is a mirror image relationship between the image A formed on the image-forming object 141 and the image A formed on the image-receptive layer 133 in the intermediate transfer medium 131. Therefore, regarding an image, a letter, or a mark, a reverse image should be previously formed.

Figure 10:
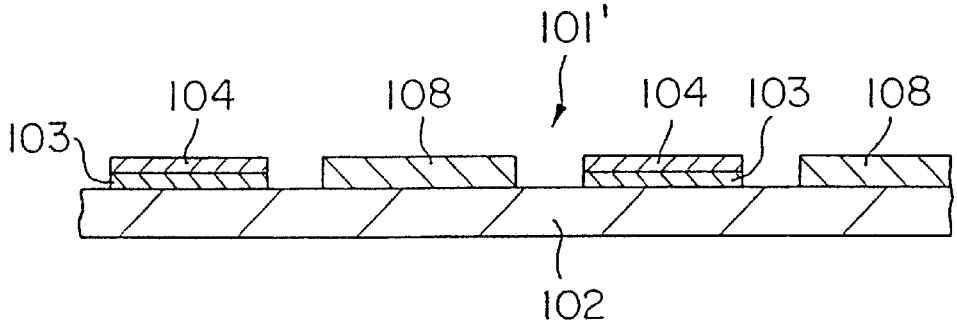

In all the above embodiments of the transfer sheet for an adhesive layer according to the present invention, a peel layer and an adhesive layer are laminated on substantially the whole area of one surface of the substrate sheet. However, the transfer sheet for an adhesive layer according to the present invention is not limited to these embodiments only. For example, as shown in FIG. 10, a laminate of a peel layer 103 and an adhesive layer 104 and an image-receptive layer 108 may be formed in a face serial manner onto a substrate sheet 102 to constitute a transfer sheet for an adhesive layer (an intermediate transfer medium integral with an adhesive layer) 101'. The use of the intermediate transfer medium 101' integral with an adhesive layer is advantageous in that, after the peel layer 103 and the adhesive layer 104 are first transferred onto the image-forming surface of the image-forming object by transfer means, the same transfer means can be used to transfer the image-receptive layer 108, together with an image formed thereon, onto the image-forming object.

Third Aspect of Invention

Figure 11:
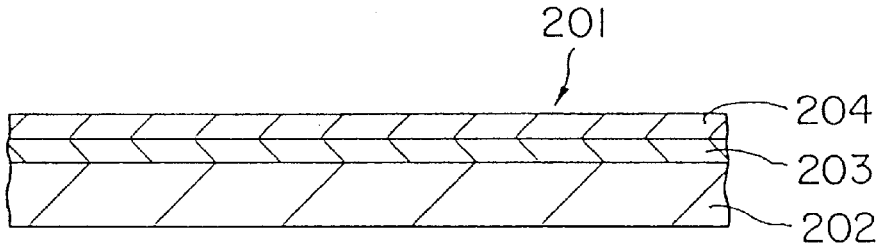

FIG. 11 is a schematic cross-sectional view showing an embodiment of the transfer sheet, for an adhesive layer, according to the third aspect of the present invention. In FIG. 11, a transfer sheet 201 for an adhesive layer comprises a substrate sheet 202 and an adhesive layer 204 provided on the substrate sheet 202 through a release layer 203. The transfer sheet 201 for an adhesive layer according to the present invention is characterized in that a release layer 203 is provided between the substrate sheet 202 and the adhesive layer 204.

The release layer 203 constituting the transfer sheet 201 for an adhesive layer is formed of a resin, examples of which include: thermoplastic resins, for example, acrylic resins, such as polymethyl methacrylate, polyethyl methacrylate, and polybutyl methacrylate, vinyl resins, such as polyvinyl acetate, vinyl chloride/vinyl acetate copolymer, polyvinyl alcohol, polyvinyl butyral, and polyvinyl acetal, cellulose derivatives, such as ethyl cellulose, nitrocellulose, and cellulose acetate; and thermosetting resins, for example, unsaturated polyester resins, polyester resins, polyurethane resins, and aminoalkyd resins.

When no satisfactory release effect of the release layer 203 can be attained by the sole use of the thermoplastic resin, it is preferred to add a release agent to the release layer 203. Release agents usable herein include silicone compounds, wax, melamine resin, fluororesin, talc, finely divided silica, and lubricants, such as surfactants and metal soaps. Among them, silicone compounds are particularly preferred. Specific examples of silicone compounds include silicone oils, such as dimethyl silicone, epoxy-modified silicone, reactive silicone, alkyl-modified silicone, and amino-modified silicone oils, reaction products of a polyester resin or an epoxy resin with a silane coupling agent, silicone rubbers, silicone compounds, and silicone waxes. The addition of the above release agent to the adhesive layer 4 can improve the release effect. This, however, deteriorates the adhesive property of the adhesive layer 204 when the adhesive layer 204 and paper are adhered to each other. Therefore, as described above, the addition of the release agent to the release layer 203 is preferred.

The above release layer 203 can be formed by coating a coating liquid comprising a binder resin or a coating liquid comprising a binder resin, with a release agent incorporated therein, onto a substrate sheet 202 by a conventional method such as gravure printing, screen printing, or reverse roll coating using a gravure plate, and the thickness thereof is preferably about 0.05 to 5 $\mu$m.

Figure 12:
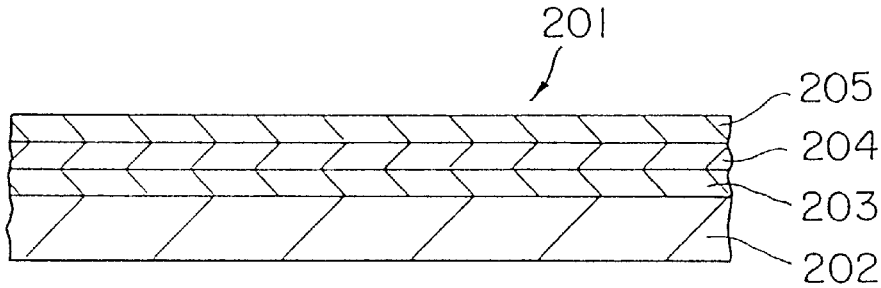

As shown in FIG. 12, the transfer sheet for an adhesive layer according to the present invention may have such a construction that a second adhesive layer 205 is provided on the adhesive layer 204. When the adhesive layer has a laminate structure of the first adhesive layer 204 and the second adhesive layer 205, it becomes possible to provide a transfer sheet for an adhesive layer which has an adhesive determined by taking into consideration the adhesion to an transfer material (an intermediate transfer medium) and the adhesion at the time of transfer of an image formed on the transfer material (intermediate transfer medium) onto an image-forming object. Specifically, the construction of the adhesive layer may be such that the second adhesive layer 205 is designed so as to have good adhesion to the transfer material (intermediate transfer medium) onto which the adhesive layer is transferred by means of the transfer sheet 201 for an adhesive layer, while, for the first adhesive layer 204, after transfer onto the transfer material (intermediate transfer medium), it is located on the surface of the transferred adhesive layer and, hence, may be designed so as to have suitable adhesion to an image-forming object onto which the transfer material (intermediate transfer medium) with an image formed thereon is transferred. The second adhesive layer 205 may be formed in the same manner as described above in connection with the formation of the first adhesive layer 204. Suitable materials for the adhesive layer may be selected depending upon applications.

Figure 13:
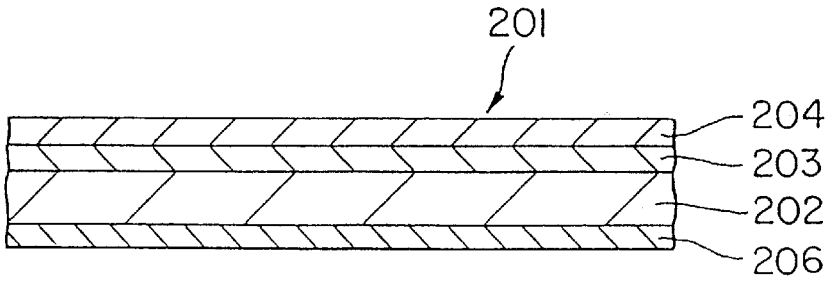

Further, the transfer sheet for an adhesive layer according to the present invention may be a construction shown in FIG. 13. Specifically, it may comprise a substrate sheet 202, a release layer 203 and an adhesive layer 204 provided on one surface of the substrate sheet 202, and a back surface layer 206 on the other side of the substrate sheet 202.

It is a matter of course that, also when the adhesive layer has the above laminate structure of the first adhesive layer 204 and the second adhesive layer 205, the back surface layer 206 may be formed on the other surface of the substrate sheet 202. The transfer of the adhesive layer using the transfer sheet for an adhesive layer may be carried out in the same manner as described above in connection with the first aspect of the present invention.

Figure 14:
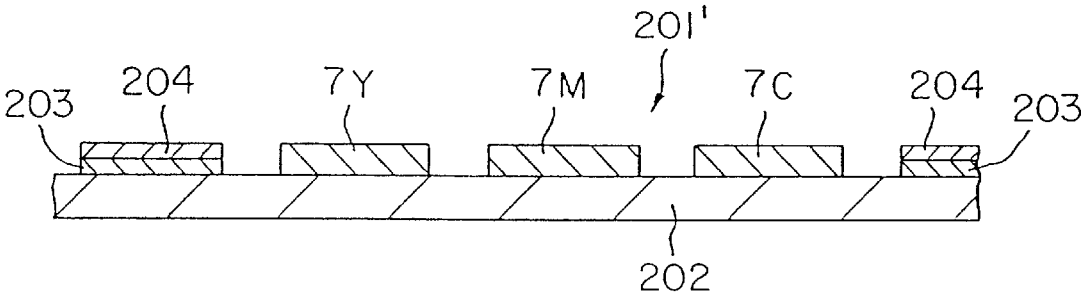

In all the above embodiments of the transfer sheet for an adhesive layer according to the present invention, an adhesive layer is provided on substantially the whole area of one surface of the substrate sheet. The transfer sheet for an adhesive layer according to the present invention is not limited to these embodiments only. For example, as shown in FIG. 14, a laminate of a release layer 203 and an adhesive layer 204, a dye layer 7Y, a dye layer 7M, and a dye layer 7C may be formed in a face serial manner on a substrate sheet 202 to constitute a transfer sheet for an adhesive layer (a thermal transfer sheet integral with an adhesive layer) 201'. The use of the thermal transfer sheet 201' integral with an adhesive layer is advantageous in that, in the above image formation, an image is formed on the image-receptive layer in the intermediate transfer medium by the transfer of the dye layer and the thermal head for the formation of an image as such may be used to continuously transfer and form an adhesive layer on the image-receptive layer.

Figure 15:
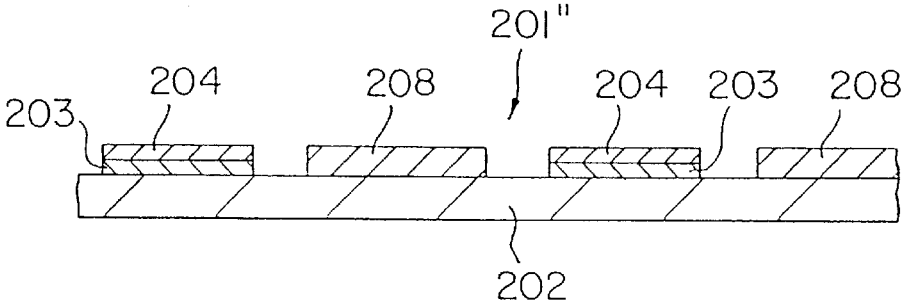

Further, in a further embodiment of the transfer sheet for an adhesive layer according to the present invention, as shown in FIG. 15, a laminate of a release layer 203 and an adhesive layer 204 and an image-receptive layer 208 may be formed in a face serial manner onto a substrate sheet 202 to constitute a transfer sheet for an adhesive layer (an intermediate transfer medium integral with an adhesive layer) 201". The use of the intermediate transfer medium 201 " integral with an adhesive layer is advantageous in that, after the adhesive layer 204 is first transferred onto the image-forming surface of the image-forming object by transfer means, the same transfer means can be used to transfer the image-receptive layer 208, together with an image formed thereon, onto the image-forming object.

Fourth Aspect of Invention

Figure 16:
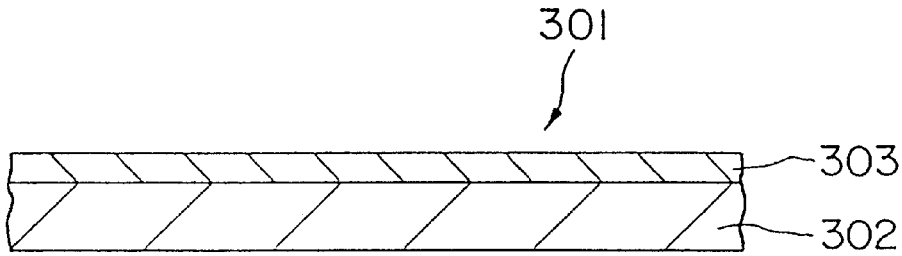

FIG. 16 is a schematic cross-sectional view showing an embodiment of the transfer sheet, for an adhesive layer, according to the fourth aspect of the present invention. In FIG. 16, a transfer sheet 301 for an adhesive layer comprises a substrate sheet 302 and an adhesive layer 303 separably provided on the substrate sheet 302. The transfer sheet 301 for an adhesive layer is characterized in that the adhesive layer 303 has low tackiness.

By virtue of the above construction of the transfer sheet 301 according to the present invention, the adhesive layer which has been transferred onto a transfer material has low tackiness and, even after it is brought into contact with a different object in the case of transfer of the transfer material onto the different object through the adhesive layer, can be released from and re-adhered to the different material.

Preferably, the adhesive layer 303 having low tackiness is formed of a material which has low tackiness at room temperature and can develop an adhesive property upon heating. Examples of materials usable herein include thermoplastic synthetic resins, natural resins, rubbers, and waxes. The term "low tackiness" used herein refers to such a state that the peel strength is in the range of from 5 to 150 gf/inch as measured by a method wherein an adhesive layer is coated in a width of one inch (25.4 mm) on a desired substrate, a postal card is put on top of the coated surface, a load of 20 g/cm$^2$ is applied to the laminate for one min, and 180° peeling (peel rate=20 cm/min) of the substrate is carried out at 25° C. using Tensilon (manufactured by Orientec Co. Ltd.).

More specific examples of the material usable for constituting the adhesive layer 303 include synthetic resins, for example, cellulose derivatives, such as ethyl cellulose and cellulose acetate propionate, styrene resins, such as polystyrene and poly-$\alpha$-methylstyrene, acrylic resins, such as polymethyl methacrylate and polyethyl acrylate, vinyl resins, such as polyvinyl chloride, polyvinyl acetate, vinyl chloride/vinyl acetate copolymer, polyvinyl butyral, and polyvinyl acetal, polyester resins, polyamide resins, epoxy resins, polyurethane resins, ionomers, ethylene/acrylic acid copolymer, and ethylene/acrylic ester copolymer; and natural resins and derivatives of synthetic rubbers, usable as a tackifier, such as rosin, rosin-modified maleic acid resins, ester gums, polyisobutylene rubber, butyl rubber, styrene/butadiene rubber, butadiene/acrylonitrile rubber, polyamide resins, and polychlorinated polyolefins.

The adhesive layer 303 may be formed of a composition comprising one or more materials described above. The thickness thereof can be determined by taking into consideration the necessary adhesive property and the processability. In general, however, it is preferably about 0.1 to 200 $\mu$m.

In the present invention, a peel layer as described in the embodiments of the first aspect of the invention, an interposing layer as described in the embodiments of the second aspect of the invention, and a release layer as described in the embodiments of the third aspect of the present invention may be provided.

In such a transfer sheet for an adhesive layer, the adhesive layer has a glass transition point below that of the peel layer and is formed of a suitable material selected from the above materials for an adhesive layer. For example, the adhesive layer may be formed of a material having a glass transition point in the range of from −70 to 0° C., preferably in the range of from −60 to −20° C. More specifically, an adhesive layer may be formed of acrylic resin, (meth)acrylate-styrene resin, polyvinyl acetate resin, polyurethane resin, polyester resin, polyvinyl alcohol, polyisobutylene rubber, butyl rubber, styrene-butadiene rubber, butadiene-acrylonitrile rubber or the like.

In the present invention, a filler is preferably added to the adhesive layer, the interposing layer, and the peel layer from the viewpoint of improving the transferability. In this case, conventional organic or inorganic fillers may be used. Examples of fillers usable herein include organic fillers, such as acrylic, nylon, and teflon fillers and polyethylene wax, and inorganic fillers, such as fine particles of various metal oxides including titanium oxide, zinc oxide, kaolin clay, calcium carbonate, finely divided silica, zinc oxide, and tin oxide.

The particle diameter of the filler is preferably in the range of from 0.05 to 10 $\mu$m, and the amount of the filler added is preferably in the range of from 10 to 300 parts by weight based on 100 parts by weight of the resin for constituting the adhesive layer, the interposing layer, or the peel layer.

Figure 17:
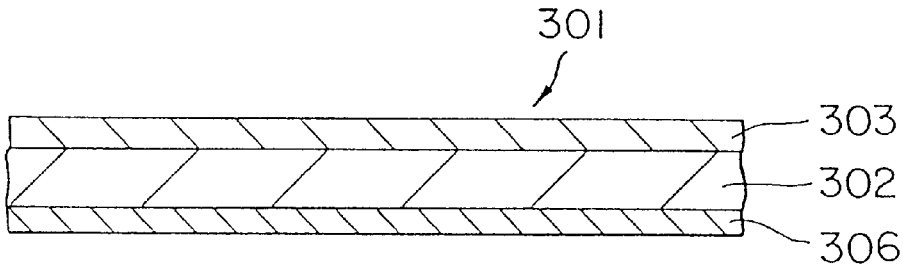

Further, according to another embodiment of the present invention, as shown in FIG. 17, the transfer sheet for an adhesive layer according to the present invention may comprise a substrate sheet 302, an adhesive layer 303 provided on one surface of the substrate sheet 302, and a back surface layer 306 provided on the other surface of the substrate sheet 302.

It is a matter of course that when an interposing layer is provided on the adhesive layer, or when a peel layer is provided between the substrate sheet and the adhesive layer, a back surface layer may be provided on the other surface of the substrate sheet.

One embodiment of the image-forming method using a transfer sheet, for an adhesive layer, including an interposing layer will be described with reference to FIGS. 18 and 19.

Figure 18A:
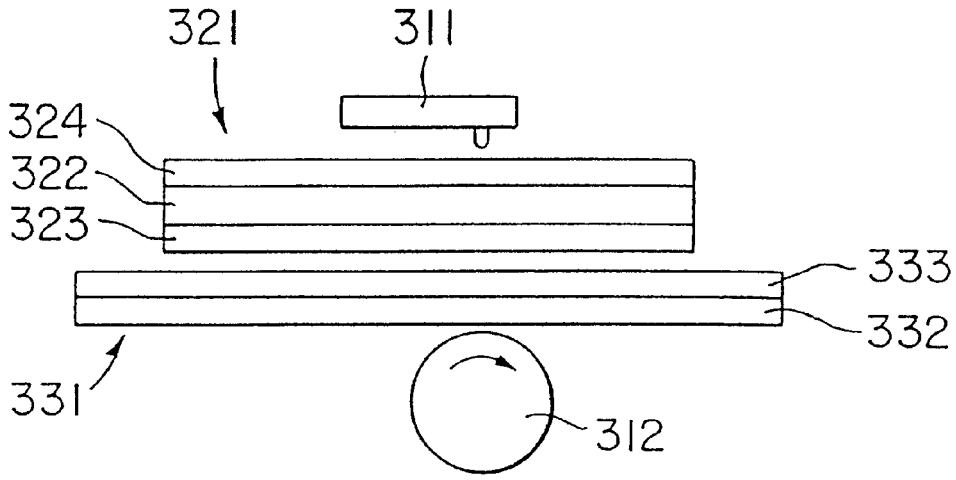
Figure 18B:
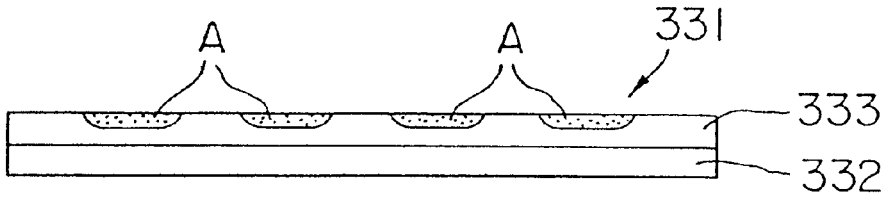

At the outset, an intermediate transfer medium 331 is put on top of a sublimation type thermal transfer sheet 321 so that a dye layer 323 in the thermal transfer sheet 321 comes into contact with an image-receptive layer 333 in the intermediate transfer medium 331. In this state, the intermediate transfer sheet 331 and the thermal transfer sheet 321 are passed through between a thermal head 311 and a platen roller 312 and brought into press-contact with each other by means of the thermal head 311 and the platen roller 312. In this case, the thermal head 311 is heated according to image data (FIG. 18A). Thus, a sublimable dye contained in the dye layer 323 is transferred onto the image-receptive layer 333 in the intermediate transfer medium 331 to form an image A (FIG. 18B). In the embodiment shown in the drawings, the thermal transfer sheet 321 comprises a substrate sheet 322, a dye layer 323 provided on one surface of the substrate sheet 322, and a back surface layer 324 on the other surface of the substrate sheet 322. On the other hand, the intermediate transfer medium 331 comprises a substrate sheet 332 bearing an image-receptive layer 333.

Figure 18C:
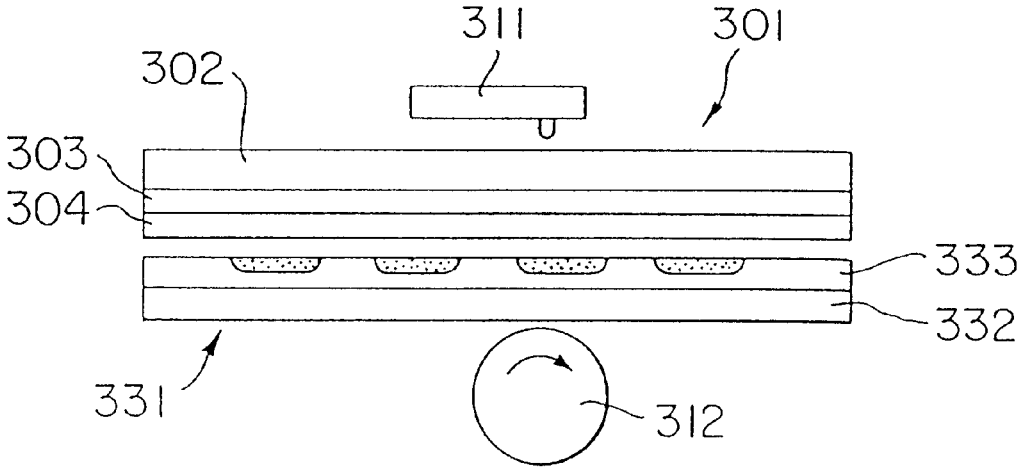
Figure 19A:
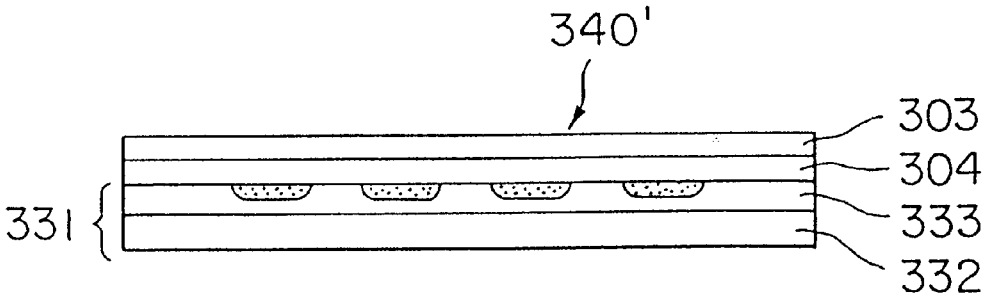

Then, a thermal transfer sheet 301' for an adhesive layer is put on top of the intermediate transfer medium 331 with the image A formed thereon so that an interposing layer 304 in the transfer sheet 301' for an adhesive layer comes into contact with the image-receptive layer 333 in the intermediate transfer medium 331 (transfer material) with the image A formed thereon. In this state, the intermediate transfer sheet 331 with the image A formed thereon and the transfer sheet 301' for an adhesive layer are passed through between the thermal head 311 and the platen roller 312 and brought into press-contact with each other by means of the thermal head 311 and the platen roller 312, and the thermal head 311 is heated (FIG. 18C). This causes separation between the substrate sheet 302 and the adhesive layer 303 in the thermal transfer sheet 301' for an adhesive layer, resulting in transfer of the adhesive layer 303 onto the image-receptive layer 333 in the intermediate transfer medium 331 as a transfer material through the interposing layer 304. Thus, an intermediate object 340' with an image formed thereon is formed (FIG. 19A). In the transfer of the adhesive layer 303, as described above, since the interposing layer 304 has good adhesion to the image-receptive layer 333 and, at the same time, a capability of preventing bleeding dyes and other properties, there is no need to impart such properties to the adhesive layer 303. Further, the adhesive layer 303 has low tackiness.

Figure 19B:
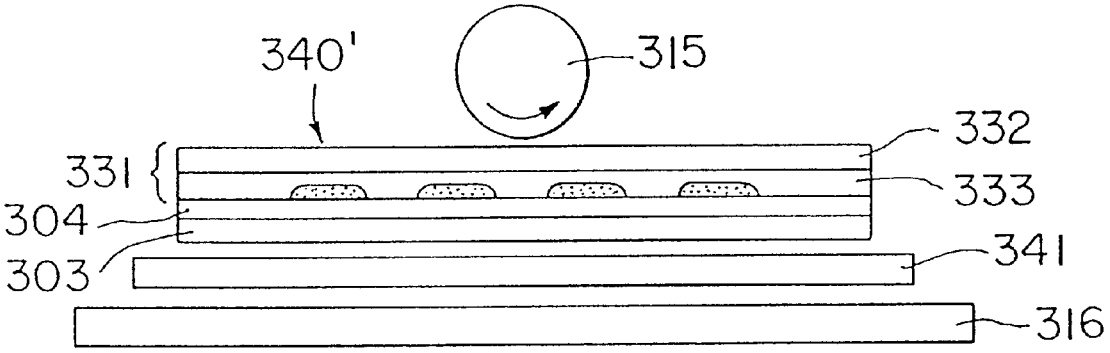
Figure 19C:
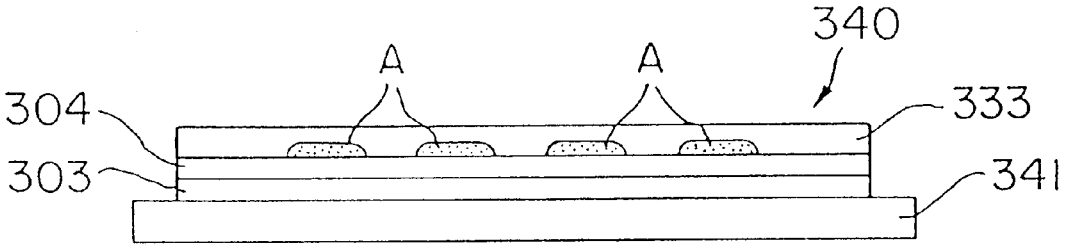

Subsequently, registration is carried out between the adhesive layer 303 in the intermediate transfer medium 331 constituting the intermediate object 340' with an image formed thereon and the image-forming object 341. In this case, as described above, since the adhesive layer 303 has low tackiness, registration can be performed as follows. Specifically, the image-forming object 341 once comes into contact with the adhesive layer 303 to conduct positioning. If positioning is improper, the image-forming object 341 is separated from the adhesive layer 303 and again comes into contact with the adhesive layer 303 to conduct positioning. That is, temporary adhering of the image-forming object 341 to the adhesive layer 303 on the intermediate transfer medium 331 and separation of the adhesive layer therefrom can be repeated a plurality of times until proper registration is achieved. After the completion of the registration, heat and pressure are applied to the laminate of the intermediate transfer medium 331 and the image-forming object 341 by means of the heat roller 315 and the platen 316 (FIG. 19B). This result in the transfer of the image-receptive layer 333 in the intermediate transfer medium 331 onto the image-forming object 341 through the adhesive layer 303 to transfer and form the image A on the image-forming object 341, thereby preparing an object 340 with an image formed thereon according to the present invention (FIG. 19C). In the transfer of the image-receptive layer 333 onto the image-forming object 341, the adhesion of the adhesive layer 303 to the image-forming object 341 is so good that the adhesion of the image-receptive layer 333 to the image-forming object 341 is very good. Further, even though the adhesive layer 303 penetrates into the image-forming object 341, there is no fear of the image quality being deteriorated by appearance of the surface state of the image-forming object 341 on the image A because, as described above, the interposing layer 304 has a capability of preventing penetration and the like.

In the above embodiment, after the completion of registration, heat and pressure are applied to the laminate of the intermediate transfer medium 331 in the intermediate object 340' with an image formed thereon and the image-forming object 341 by means of the heat roller 315 and the platen 316. In the present invention, however, the heat and pressure may not be applied to provide the image-forming object 340.

Another embodiment of the image-forming method using the transfer sheet 301" for an adhesive layer according to the present invention will be described with reference to FIGS. 20 and 21.

Figure 20A:
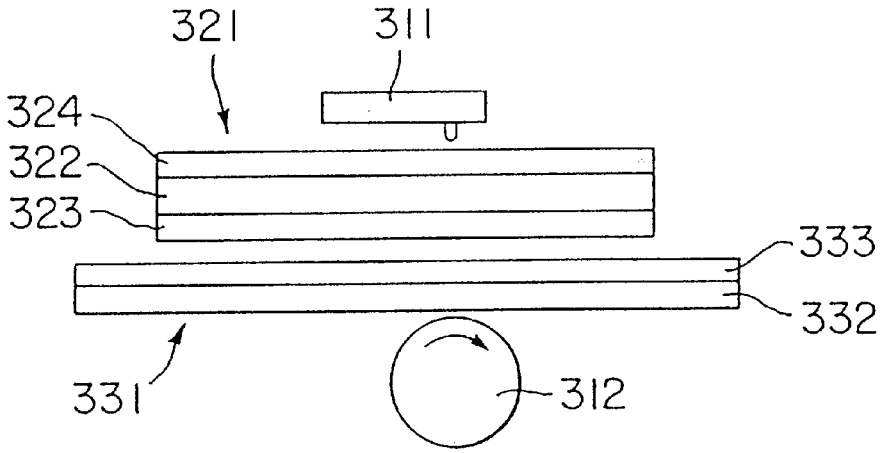
Figure 20B:
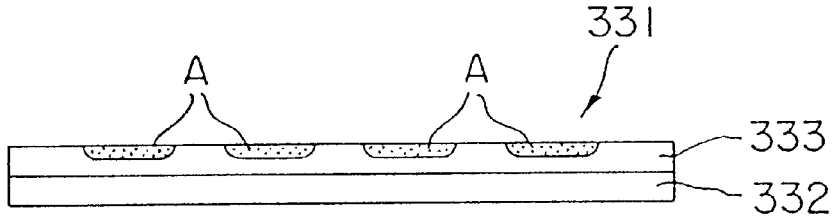

At the outset, an intermediate transfer medium 331 is put on top of a sublimation type thermal transfer sheet 321 in the same manner as described above in connection with the above embodiment, and in this state, the intermediate transfer sheet 331 and the thermal transfer sheet 321 are passed through between a thermal head 311 and a platen roller 312 and brought into press-contact with each other by means of the thermal head 311 and the platen roller 312. In this case, the thermal head 311 is heated according to image data (FIG. 20A). Thus, a sublimable dye contained in the dye layer 323 is transferred onto the image-receptive layer 333 in the intermediate transfer medium 331 to form an image A (FIG. 20B).

Figure 20C:
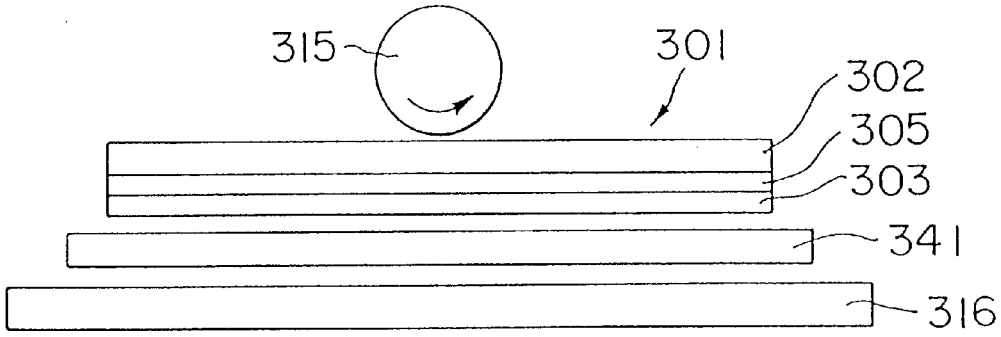
Figure 21A:
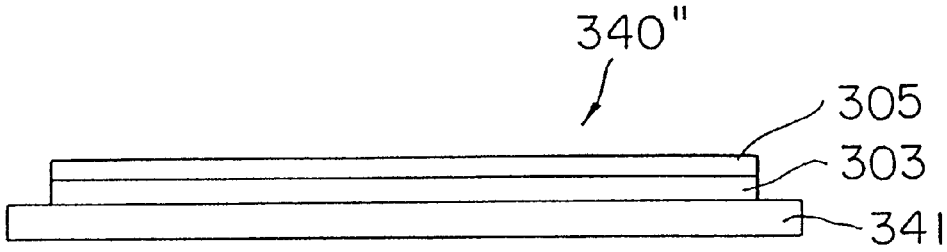

Then, the transfer sheet 301" for an adhesive layer is put on top of the image-forming object 341 so that the adhesive layer 303 in the transfer sheet 301" for an adhesive layer comes into contact with the image-forming object 341. Heat and pressure are applied to the laminate by means of a heat roller 315 and a platen 316 (FIG. 20C). By this operation, separation occurs between the substrate sheet 302 in the transfer sheet 301 for an adhesive layer and the peel layer 305, and the adhesive layer 304, together with the peel layer 305, is transferred onto the image-forming object 341. Thus, an intermediate image-forming object 340" is formed (FIG. 21A).

Figure 21B:
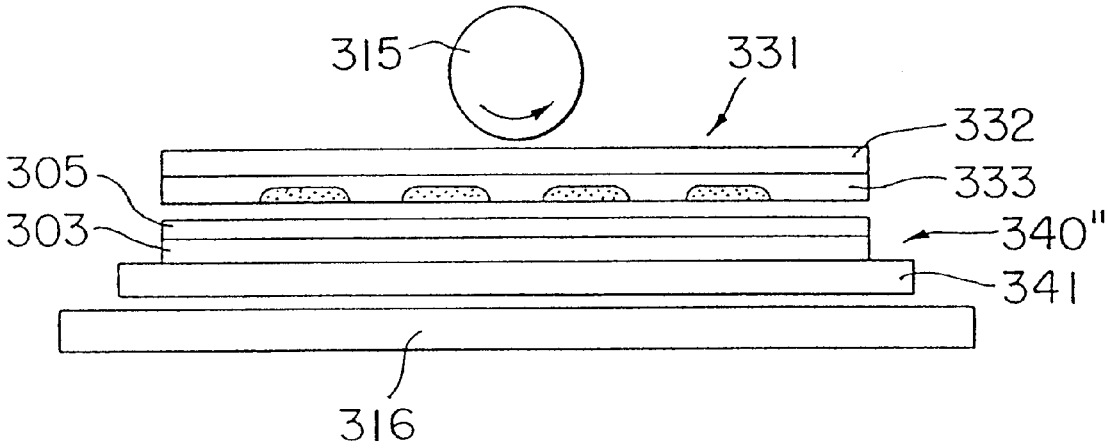
Figure 21C:
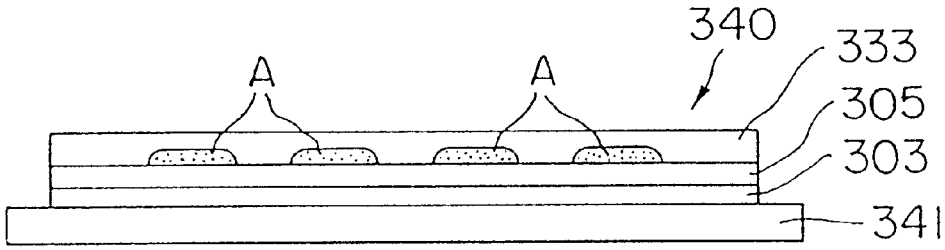

Then, the image receptive layer 333 in the intermediate transfer medium 331 with the image A formed thereon is put on top of the peel layer 305 provided on the image-forming object 341 constituting the intermediate image-forming object 340", and heat and pressure are applied to the laminate by means of the heat roll 315 and the platen 316 (FIG. 21B). This results in the transfer of the image-receptive layer 333 in the intermediate transfer medium 331 onto the image-forming object 341 through the peel layer 305 and the adhesive layer 303 to transfer and form the image A on the image-forming object 341, thereby preparing an object 340 with an image formed thereon according to the present invention (FIG. 21C) In the above embodiment, after the completion of registration, heat and pressure are applied to the laminate of the intermediate transfer medium 331 and the image-forming object 341 in the intermediate image-forming object 340" by means of the heat roller 315 and the platen 316. In the present invention, however, the heat and pressure may not be applied to provide the image-forming object 340.

There is a mirror image relationship between the image A formed on the image-forming object 341 and the image A formed on the image-receptive layer 333 in the intermediate transfer medium 331. Therefore, regarding an image, a letter, or a mark, a reverse image should be previously formed.

Figure 22:
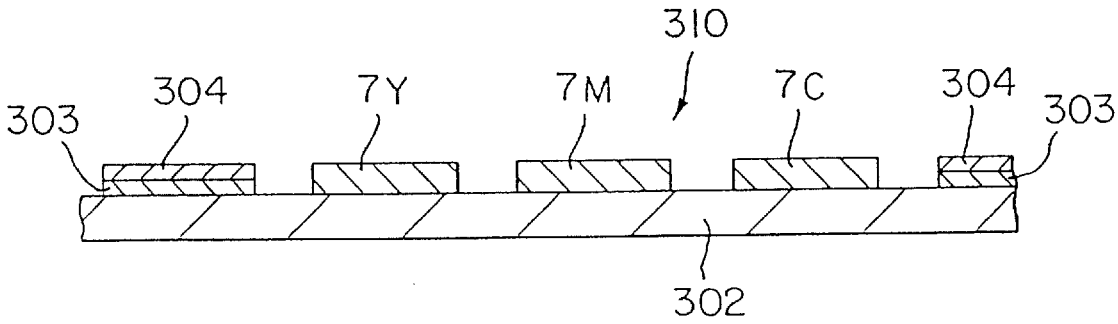

In all the above embodiments of the transfer sheet according to the present invention, an adhesive layer and an interposing layer are provided on substantially the whole area of one surface of the substrate sheet. The transfer sheet for an adhesive layer according to the present invention is not limited to these embodiments only. For example, as shown in FIG. 22, a laminate of an adhesive layer 303 and an interposing layer 304, a dye layer 7Y, a dye layer 7M, and a dye layer 7C are formed in a face serial manner on a substrate sheet 302 to constitute a transfer sheet for an adhesive layer (a thermal transfer sheet integral with an adhesive layer) 310. The use of the thermal transfer sheet 310 integral with an adhesive layer is advantageous in that, in the above image formation, an image is formed on the image-receptive layer in the intermediate transfer medium by the transfer of the dye layer and the thermal head for the formation of an image as such may be used to continuously transfer and form an adhesive layer on the image-receptive layer.

Figure 23:
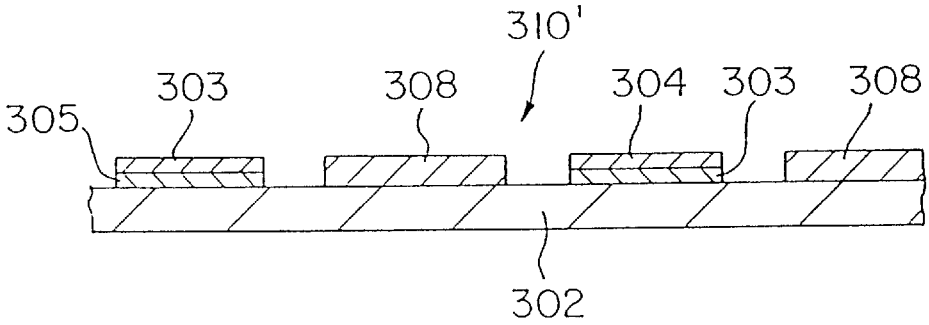

Further, in a further embodiment of the transfer sheet for an adhesive layer according to the present invention, as shown in FIG. 23, a laminate of a peel layer 305 and an adhesive layer 303 and an image-receptive layer 308 may be formed in a face serial manner onto a substrate sheet 302 to constitute a transfer sheet for an adhesive layer (an intermediate transfer medium integral with an adhesive layer) 310'. The use of the intermediate transfer medium 310' integral with an adhesive layer is advantageous in that, after the peel layer 305 and the adhesive layer 303 are first transferred onto the image-forming surface of the image-forming object by transfer means, the same transfer means can be used to transfer the image-receptive layer 308, together with an image formed thereon, onto the image-forming object.

The transfer sheet for an adhesive layer according to the present invention will be described in more detail with reference to the following examples.

EXAMPLE A

Preparation of Transfer Sheets for Adhesive Layer (Samples 1 to 5)

A 6 $\mu$m-thick polyethylene terephthalate film (Lumirror, manufactured by Toray Industries, Inc.) with a back surface layer coated thereon was provided as a substrate sheet. A coating liquid, for an adhesive layer, having the following composition was coated by gravure coating on the substrate sheet, and the coating was dried (coverage on a dry basis: 3 g/m$^2$) to form an adhesive layer.

| (Composition of coating liquid X for adhesive layer) | |
|---|---|
| Polyamide resin (Tg: 50° C.) (Macromelt 6240, manufactured by Henkel Hakusui Corp.) | 100 parts by weight |
| Methyl ethyl ketone | 500 parts by weight |
| **(Composition of coating liquid Y for adhesive layer)** | |
| Polyester resin (Tg: 75° C.) (UE3600, manufactured by Unitika Ltd.) | 100 parts by weight |
| Methyl ethyl ketone | 500 parts by weight |

Then, different resin coating liquids, for an interposing layer, having the following respective compositions were coated by gravure coating on the adhesive layer, and the coatings were dried (coverage on a dry basis: 2 g/m$^2$) to form interposing layers, thereby preparing transfer sheets for an adhesive layer according to the present invention (samples 1 to 5).

| (Coating resin liquid A for interposing layer) | |
|---|---|
| Vinyl chloride/vinyl acetate copolymer (1000 ALK, manufactured by Denki Kagaku Kogyo K.K.) | 100 parts by weight |
| Methyl ethyl ketone | 500 parts by weight |
| (Coating resin liquid B for interposing layer) | |
| Polymethyl methacrylate resin (BR-85, manufactured by Mitsubishi Rayon Co., Ltd.) | 100 parts by weight |
| Methyl ethyl ketone | 500 parts by weight |
| (Coating resin liquid C for interposing layer) | |
| Polyester resin (Vylon 600, manufactured by Toyobo Co., Ltd.) | 100 parts by weight |
| Methyl ethyl ketone | 500 parts by weight |
| (Coating resin liquid D for interposing layer) | |
| Polymethyl methacrylate resin (LP-45M, manufactured by Soken Chemical Engineering Co., Ltd.) | 100 parts by weight |
| Methyl ethyl ketone | 500 parts by weight |

Preparation of Transfer Sheets for Adhesive Layer (Comparative Samples 1 to 3)

For comparison, a transfer sheet for an adhesive layer (comparative sample 1) was prepared in the same manner as described above in connection with the preparation of sample 1, except that no interposing layer was formed.

Further, for comparison, transfer sheets for an adhesive layer (comparative examples 2 and 3) were prepared in the same manner as described above in connection with the preparation of sample 1, except that, as the resin used in the coating liquid for an interposing layer, a releasable resin (Gosenol NH-8, manufactured by Nippon Synthetic Chemical Industry Co., Ltd.) or a resin having a low glass transition point (AE 322, manufactured by Japan Synthetic Rubber Co., Ltd.) was used instead of the vinyl chloride/vinyl acetate copolymer.

Furthermore, a transfer sheet for an adhesive layer (comparative sample 4) was prepared using the following coating liquid Z as the coating liquid for an adhesive layer and the above coating liquid A as the resin coating liquid for an interposing layer.

| (Composition of coating liquid Z for adhesive layer) | |
|---|---|
| Acrylic resin (BR-85 (Tg: 105° C.), manufactured by Mitsubishi Rayon Co., Ltd.,) | 100 parts by weight |
| Methyl ethyl ketone | 500 parts by weight |

Preparation of Intermediate Transfer Medium Sheets

A 6 $\mu$m-thick polyethylene terephthalate film (Lumirror, manufactured by Toray Industries, Inc.) with a back surface layer coated thereon was provided as a substrate sheet. A coating liquid, for a peelable protective layer, having the following composition was coated by gravure coating on the untreated surface of the substrate sheet, and the coating was dried (coverage on a dry basis: 3 g/m$^2$) to form a peelable protective layer.

| (Composition of coating liquid for peelable protective layer) | |
|---|---|
| Polymethyl methacrylate resin (BR-83, manufactured by Mitsubishi Rayon Co., Ltd.) | 100 parts by weight |
| Methyl ethyl ketone | 500 parts by weight |

Then, the following coating liquid for a receptive layer was coated by gravure coating on the releasable protective layer, and the coating was dried (coverage on a dry basis: 3 g/m$^2$) to form a dye-receptive layer, thereby preparing an intermediate transfer medium.

| (Composition of coating liquid for receptive layer) | |
|---|---|
| Vinyl chloride/vinyl acetate copolymer (VYHD, manufactured by Union Carbide Corporation) | 100 parts by weight |
| Epoxy-modified silicone (KF-393, manufactured by The Shin-Etsu Chemical Co., Ltd.) | 1 part by weight |
| Amino-modified silicone (KS-343, manufactured by The Shin-Etsu Chemical Co., Ltd.) | 1 part by weight |
| Methyl ethyl ketone | 500 parts by weight |

Thereafter, a thermal sublimation transfer sheet was used to form an image on the image-receptive layer in the intermediate transfer medium sheet, and an adhesive layer was transferred thereon using the above transfer sheets for an adhesive layer (samples 1 to 5 and comparative samples 1 to 3) under the following transfer conditions.

(Transfer Conditions)

Thermal head: 6 dots/mm

Thermal energy: 1.0 mJ/dot

The image-receptive layer and the releasable protective layer were then transferred through the transferred adhesive layer onto a postal card as an image-forming object under the above transfer conditions to prepare objects with an image formed thereon. In this case, at the time of the transfer, separation occurred between the peelable protective layer and the substrate sheet in the intermediate transfer medium sheet.

The images thus obtained were evaluated for the adhesion and image quality by the following methods. The results are given in Table A1.

(Adhesion)

A pressure-sensitive adhesive tape (Cello-Tape 545, manufactured by Nichiban Co., Ltd.) having a width of 12 mm was adhered to the image, and 180° peeling was then carried out at a peel rate of 100 cm/sec to evaluate the adhesion.

Evaluation Criteria

○: No separation occurred between the image-receptive layer and the interposing layer, and the pressure-sensitive adhesive tape alone was separated, or alternatively the image-receptive layer and the interposing layer, together with pressure-sensitive adhesive tape, were taken away, resulting in ruined surface of the card.

X: Separation occurred between the image-receptive layer and the interposing layer or between the adhesive layer and the card.

(Image Quality)

The image quality was evaluated by visual inspection.

Evaluation Criteria

○: The surface of the image was smooth, and no fiber texture of the card was observed in the image per se.

X: The influence of fiber texture of the card appeared in the image, and the creation of a streak pattern having a higher density than the area around the pattern or a streak pattern having a lower density than the area around pattern was observed.

TABLE A1

| Transfer sheet for adhesive layer | Coating liquid for adhesive layer | Coating liquid/resin for interposing layer | Adhesion | Image quality |
|---|---|---|---|---|
| Sample 1 | X | A | ○ | ○ |
| Sample 2 | X | B | ○ | ○ |
| Sample 3 | X | C | ○ | ○ |
| Sample 4 | X | D | ○ | ○ |
| Sample 5 | Y | D | ○ | ○ |
| Comparative sample 1 | X | — | X | X |
| Comparative sample 2 | X | Peelable resin | X | ○ |
| Comparative sample 3 | X | Low Tg resin | ○ | X |
| Comparative sample 4 | Z | A | X | ○ |

As is apparent from Table A1, both the adhesion and the image quality were good for all the transfer sheets for an adhesive layer (samples 1 to 5) according to the present invention.

By contrast, both the adhesion and the image quality were poor for the transfer sheet, having no interposing layer, for an adhesive layer (comparative sample 1). For the comparative sample 2 using a releasable resin for constituting the interposing layer, the adhesion of the image-receptive layer transferred onto the postal card was unsatisfactory due to poor adhesion between the interposing layer and the image-receptive layer. For the comparative sample 3 using a resin, having a low glass transition point, for constituting the interposing layer, although the adhesion was good, bleeding of the dye into the interposing layer occurred resulting in poor image quality. For the comparative sample 4, the adhesion of the adhesive layer to the image-forming object was unsatisfactory.

As is apparent from the foregoing detailed description, according to the present invention, an interposing layer is provided on the adhesive layer, and the adhesive layer is transferred onto a transfer material through the interposing layer. Therefore, when necessary properties, such as adhesion to a transfer material and prevention of bleeding of dye, are imparted to the interposing layer, properties required of the adhesive layer may be limited to those such as adhesion to the image-forming object and prevention of penetration of the adhesive, markedly increasing the degree of freedom in selection of materials for the adhesive layer and thus making it possible to provide a transfer sheet, for an adhesive layer, which has excellent properties such as excellent adhesion in the transfer to the transfer material and resistance to bleeding of the dye and, at the same time, has excellent adhesion to the image-forming object and prevention of penetration of the adhesive. The transfer of an interposing layer and an adhesive layer using the above transfer sheet, for an adhesive layer, onto an image-receptive layer of an intermediate transfer medium with an image formed thereon by transfer, followed by transfer of the image-receptive layer onto an image-forming object through the interposing layer and the adhesive layer can provide an object, with an image formed thereon, which is free from bleeding of the image and has a smooth image surface independently of the surface profile of the image-forming object.

EXAMPLE B

Preparation of Transfer Sheets for Adhesive Layer (Samples 1 to 4)

A 6 μm-thick polyethylene terephthalate film (Lumirror, manufactured by Toray Industries, Inc.) with a back surface layer coated thereon was provided as a substrate sheet. A coating liquid, for a peel layer, having the following composition was coated by gravure coating on the untreated surface of the substrate sheet, and the coating was dried (coverage on a dry basis: 1 g/m$^2$) to form a peel layer. The glass transition point of the peel layer was 65° C.

| (Composition of coating liquid for peel layer) | |
|---|---|
| Vinyl chloride/vinyl acetate copolymer (Tg = 65° C.) (1000A, manufactured by Denki Kagaku Kogyo K.K.) | 100 parts by weight |
| Epoxy-modified silicone oil (KF-393, manufactured by The Shin-Etsu Chemical Co., Ltd.) | 1 part by weight |
| Methyl ethyl ketone | 500 parts by weight |

The following coating liquid for an adhesive layer was coated by gravure coating on the peel layer, and the coating was dried (coverage on a dry basis=3 g/m$^2$) to form an adhesive layer (glass transition point: 50° C.), thereby preparing a transfer sheet for an adhesive layer according to the present invention (sample 1).

| (Composition of coating liquid for adhesive layer) | |
|---|---|
| Polyamide resin (Tg = 50° C.) (Macromelt 6240, manufactured by Henkel Hakusui Corp.) | 100 parts by weight |
| Methyl ethyl ketone | 500 parts by weight |

A transfer sheet for an adhesive layer according to the present invention (sample 2) was prepared in the same manner as described above in connection with the preparation of the sample 1, except that a coating liquid having the following composition was used as the coating liquid for a peel layer, thereby forming a peel layer (glass transition point: 65° C.).

| (Composition of coating liquid for peel layer) | |
|---|---|
| Vinyl chloride/vinyl acetate copolymer (Tg = 65° C.) (1000ALK, manufactured by Denki Kagaku Kogyo K.K.) | 100 parts by weight |
| Methyl ethyl ketone | 500 parts by weight |

A transfer sheet for an adhesive layer according to the present invention (sample 3) was prepared in the same manner as described above in connection with the preparation of the sample 1, except that a coating liquid having the following composition was used as the coating liquid for a peel layer, thereby forming a peel layer (glass transition point: 105° C.).

| (Composition of coating liquid for peel layer) | |
|---|---|
| Acrylic resin (Tg: 105° C.) (BR-85, manufactured by Mitsubishi Rayon Co., Ltd.) | 100 parts by weight |
| Methyl ethyl ketone | 500 parts by weight |

A transfer sheet for an adhesive layer according to the present invention (sample 4) was prepared in the same manner as described above in connection with the preparation of the sample 1, except that a coating liquid having the following composition was used as the coating liquid for a peel layer, thereby forming a peel layer (glass transition point: 75° C.).

| (Composition of coating liquid for peel layer) | |
|---|---|
| Polyester resin (Tg: 75° C.) (UE3600, manufactured by Unitika Ltd.) | 100 parts by weight |
| Methyl ethyl ketone | 500 parts by weight |

Preparation of Transfer Sheets for Adhesive Layer (Comparative Samples 1 and 2)

For comparison, a transfer sheet for an adhesive layer (comparative sample 1) was prepared in the same manner as described above in connection with the preparation of the sample 1, except that no peel layer was formed.

Further, for comparison, a transfer sheet for an adhesive layer (comparative sample 2) was prepared in the same manner as described above in connection with the preparation of the sample 1, except that a styrene/(meth)acrylate resin (Tg=20° C.; AE932, manufactured by Japan Synthetic Rubber Co., Ltd.) was used instead of the vinyl chloride/vinyl acetate copolymer (Tg=65° C.).

Preparation of Intermediate Transfer Medium

An intermediate transfer medium sheet was prepared in the same manner as in Example A.

A thermal sublimation transfer sheet was used to form an image on the image-receptive layer in the intermediate transfer medium.

Further, the transfer sheets for an adhesive layer (samples 1 to 4 and comparative samples 1 and 2) prepared above were used to transfer the peel layer and the adhesive layer on a postal card as an image-forming object under the following transfer conditions.

(Transfer Conditions)

Thermal head: 6 dots/mm

Thermal energy: 1.0 mJ/dot

The image-receptive layer and the releasable protective layer in the intermediate transfer medium sheet were then transferred under the above transfer conditions onto the peel layer present on the image-forming object to form an image, thereby preparing an object with an image formed thereon. In the transfer, separation occurred between the peelable protective layer and the substrate sheet in the intermediate transfer medium sheet.

The images thus obtained for the samples were evaluated for the adhesion and image quality by the following methods. The results are given in Table B1.

(Adhesion)

A pressure-sensitive adhesive tape (Cello-Tape 545, manufactured by Nichiban Co., Ltd.) having a width of 12 mm was adhered to the image, and 180° peeling was then carried out at a peel rate of 100 cm/sec to evaluate the adhesion.

Evaluation Criteria

○: No separation occurred between the image-receptive layer and the peel layer, and the pressure-sensitive adhesive tape alone was separated.

X: Separation occurred between the image-receptive layer and the peel layer.

(Image Quality)

The image quality was evaluated by visual inspection.

Evaluation Criteria

○: The surface of the image was smooth, and no fiber texture of the card was observed in the image per se.

X: The influence of fiber texture of the card appeared in the image, and the creation of a streak pattern having a higher density than the area around the pattern or a streak pattern having a lower density than the area around pattern was observed.

TABLE B1

| Transfer sheet for adhesive layer | Glass transition point of peel layer | Adhesion | Image quality |
|---|---|---|---|
| Sample 1 | 65° C. | ○ | ○ |
| Sample 2 | 65° C. | ○ | ○ |
| Sample 3 | 105° C. | ○ | ○ |
| Sample 4 | 75° C. | ○ | ○ |
| Comparative sample 1 | — | X | Fiber texture |
| Comparative sample 2 | 20° C. | ○ | Fiber texture |

(Glass Transition Point of Adhesive Layer: 50° C.)

As is apparent from Table B1, all the transfer sheets for an adhesive layer according to the present invention, the transfer sheets being provided with a peel layer having a glass transition point above the adhesive layer (samples 1 to 4), had good adhesion and a good image quality with no fiber texture observed in the image.

By contrast, for the transfer sheet for an adhesive layer having no peel layer (comparative sample 1), the adhesion was unsatisfactory, and a fiber texture was observed due to penetration of the adhesive layer into the postal card, resulting in poor image quality. For the comparative sample 2 provided with a peel layer having a lower glass transition point than the adhesive layer, although the adhesion was good, the fiber texture was observed due to the penetration of the adhesive layer into the postal card and, in addition, the image quality was poor.

As is apparent from the foregoing detailed description, according to the present invention, since the adhesive layer is provided on the substrate sheet through a peel layer having a higher glass transition point than the adhesive layer, separation satisfactorily occurs between the substrate sheet and the peel layer and the adhesive layer, together with the peel layer, is transferred onto the transfer material. Therefore, it is possible to use an adhesive layer having desired properties such as good adhesion to the transfer material although the adhesive layer has poor releasability from the substrate sheet. Further, the peel layer is located on the surface of the transferred adhesive layer and functions to maintain good surface profile even when the adhesive layer has penetrated into the transfer material. Thus, it is possible to provide a transfer sheet, for an adhesive layer, wherein the adhesive layer has good releasability, high adhesion to a transfer material and the transferred adhesive layer has good surface smoothness. Further, an object, with an image formed thereon, prepared by transferring an adhesive layer and a peel layer, using the above transfer sheet for an adhesive layer, onto an image-forming object and transferring an image-receptive layer in an intermediate transfer medium, with an image transferred thereonto, onto the peel layer is free from bleeding of the image and smooth independently of the surface profile of the image-forming object.

EXAMPLE C

Preparation of Transfer Sheet for Adhesive Layer (Sample 1)

A 6 μm-thick polyethylene terephthalate film (Lumirror, manufactured by Toray Industries, Inc.) with a back surface layer coated thereon was provided as a substrate sheet. A coating liquid, for a release layer, having the following composition was coated by gravure coating on the untreated surface of the substrate sheet, and the coating was dried (coverage on a dry basis: 1 g/m$^2$) to form a release layer.

| (Composition of coating liquid for release layer) | |
|---|---|
| Polyurethane (Crisvon 9004, manufactured by Dainippon Ink and Chemicals, Inc.) | 100 parts by weight |
| Dimethylformamide | 300 parts by weight |
| Epoxy-modified silicone (KF-393, manufactured by The Shin-Etsu Chemical Co., Ltd.) | 5 parts by weight |

The following coating liquid for a first adhesive layer was coated by gravure coating on the release layer, and the coating was dried (coverage on a dry basis=3 g/m$^2$) to form a first adhesive layer. Thereafter, the following coating liquid for a second adhesive layer was coated by gravure coating on the first adhesive layer, and the coating was dried (coverage on a dry basis=4 g/m$^2$) to form a second adhesive layer, thereby preparing an adhesive layer constituted by the first adhesive layer and the second adhesive layer. Thus, a transfer sheet for an adhesive layer according to the present invention (sample 1) was prepared.

| (Composition of coating liquid for first adhesive layer) | |
|---|---|
| Polyamide resin (Macromelt 6240, manufactured by Henkel Hakusui Corp.) | 100 parts by weight |
| Methyl ethyl ketone | 500 parts by weight |
| **(Composition of coating liquid for second adhesive layer)** | |
| Vinyl chloride/vinyl acetate copolymer (1000A, manufactured by Denki Kagaku Kogyo K.K.) | 100 parts by weight |
| Methyl ethyl ketone | 500 parts by weight |

Preparation of Transfer Sheet for Adhesive Layer (Sample 2)

A transfer sheet for an adhesive layer according to the present invention (sample 2) was prepared in the same manner as described above in connection with the preparation of the sample 1, except that a coating liquid, for an adhesive layer, having the following composition was used as the coating liquid for an adhesive layer and coated by gravure coating and the coating was dried (coverage on a dry basis=4 g/m$^2$) to form an adhesive layer having a single layer structure.

| (Composition of coating liquid for adhesive layer) | |
|---|---|
| Acrylic resin (BR-85, manufactured by Mitsubishi Rayon Co., Ltd.) | 10 parts by weight |
| Methyl ethyl ketone | 500 parts by weight |

Preparation of Transfer Sheet for Adhesive Layer (Sample 3)

A transfer sheet for an adhesive layer (sample 3) was prepared in the same manner as described above in connection with the preparation of the sample 1, except that an epoxy-modified silicone (KF-393, manufactured by The Shin-Etsu Chemical Co., Ltd.) as a release agent was incorporated into the first adhesive layer instead of the release layer.

Preparation of Comparative Transfer Sheet for Adhesive Layer (Comparative Samples 1 and 2)

For comparison, a transfer sheet for an adhesive layer (comparative sample 1) was prepared in the same manner as described above in connection with the sample 1, except that no release layer was formed.

Further, for comparison, a transfer sheet for an adhesive layer (comparative sample 2) was prepared in the same manner as described above in connection with the sample 2, except that no release layer was formed.

The transfer sheets for an adhesive layer (samples 1 to 3 and comparative samples 1 and 2) thus prepared were evaluated for the transferability of the adhesive layer, and the evaluation results are summarized in Table C1.

(Method for Evaluating Transferability)

After an image was formed on the dye-receptive layer in the intermediate transfer medium sheet, the transfer sheet for an adhesive layer was heated (1.0 mJ/dot) through the back surface layer of the transfer sheet for an adhesive layer by means of a thermal head (6 dots/mm) to transfer the adhesive layer onto the image. In this case, the transferability of the adhesive layer was observed. Subsequently, the intermediate transfer medium sheet, with an image and an adhesive layer provided thereon, was heated through the back surface layer of the intermediate transfer medium sheet by means of a thermal head under the same conditions as described above to transfer the dye-receptive layer and the peelable protective layer in the intermediate transfer medium sheet onto a postal card as an image-forming object through the adhesive layer. In this case, at the time of the transfer, separation occurred between the peelable protective layer and the substrate sheet in the intermediate transfer medium sheet. In the transfer operation, the transferability was observed. For the sample 3, in addition to the postal card, a white vinyl chloride sheet (thickness 125 μm; manufactured by Mitsubishi Plastic Industries Ltd.) was used as the image-forming object to evaluate the transferability.

TABLE C1

| Transfer sheet for adhesive layer | Transferability onto intermediate transfer medium | Transferability onto image-forming object |
|---|---|---|
| Sample 1 | The adhesive layer in the whole heated area was satisfactorily transferred onto the intermediate transfer medium. | The postal card was broken in a pressure-sensitive adhesive tape peel test. |
| Sample 2 | The adhesive layer in the whole heated area was satisfactorily transferred onto the intermediate transfer medium. | The postal card was broken in a pressure-sensitive adhesive tape peel test. |
| Sample 3 | The adhesive layer in the whole heated area was satisfactorily transferred onto the intermediate transfer medium. | (Onto postal card) In a pressure-sensitive adhesive tape peel test, separation occurred between the adhesive layer and the postal card. (Onto white vinyl chloride sheet) In a pressure-sensitive adhesive tape peel test, no separation occurred between the dye-receptive layer and the adhesive layer. |
| Comp. sample 1 | Dropout or missing of transfer occurred. | The postal card was broken in a pressure-sensitive adhesive tape peel test. |
| Comp. sample 2 | Dropout or missing of transfer occurred. | The postal card was broken in a pressure-sensitive adhesive tape peel test. |

As is apparent from Table C1, for the transfer sheets for an adhesive layer according to the present invention (samples 1 and 2), the transfer onto the intermediate transfer medium sheet could be smoothly carried out, and the transferred and formed adhesive layer had even thickness and high surface smoothness. Further, the adhesion after the transfer of the dye-receptive layer onto the postal card as an image-forming object was also satisfactory. For the transfer sheet for an adhesive layer (sample 3) as well, the transfer onto the intermediate transfer medium sheet was smoothly carried out. However, although the adhesion after the transfer of the dye-receptive layer onto the white vinyl chloride sheet as the image-forming object was satisfactory, the adhesion after the transfer of the dye-receptive layer onto the postal card was unsatisfactory. This demonstrates that, when the adhesive layer is adhered to paper, the incorporation of a release agent into the adhesive layer is unfavorable.

On the other hand, for the transfer sheets, for an adhesive layer, having no release layer (comparative samples 1 and 2), some part to be transferred onto the intermediate transfer medium sheet was not transferred, and, in addition, the transferred and formed adhesive layer had uneven thickness and low surface smoothness.

As is apparent from the foregoing detailed description, according to the present invention, since the adhesive layer is provided on the substrate sheet through a release layer, it is held by the release layer in suitable low tackiness and, at the time of transfer, satisfactory separation occurs between the adhesive layer and the release layer so that the adhesive layer is transferred onto a transfer material without being left on the substrate sheet side. Therefore, the transferred and formed adhesive layer has even thickness and high surface smoothness.

EXAMPLE D1

Preparation of Transfer Sheets for Adhesive Layer (Samples 1 to 7)

A 6 μm-thick polyethylene terephthalate film (Lumirror, manufactured by Toray Industries, Inc.) with a back surface layer coated thereon was provided as a substrate sheet. Then, different coating liquids, for an adhesive layer, having the following respective compositions were coated by gravure coating on the untreated surface of the substrate sheet, and the coatings were dried (coverage on a dry basis: 3 g/m$^2$) to form adhesive layers having low tackiness.

| | |
|---|---|
| (Composition of coating liquid A for adhesive layer) | |
| Acrylic emulsion containing acrylic fine particles (T-700, manufactured by Soken Chemical Engineering Co., Ltd.) | 100 parts by weight |
| Pure water | 500 parts by weight |
| (Composition of coating liquid B for adhesive layer) | |
| Acrylic emulsion (RE-4, manufactured by Soken Chemical Engineering Co., Ltd.) | 100 parts by weight |
| Pure water | 500 parts by weight |
| (Composition of coating liquid C for adhesive layer) | |
| Rubber-based pressure-sensitive adhesive (Olivine BPS 4936-2, manufactured by Toyo Ink Manufacturing Co., Ltd.) | 100 parts by weight |
| Vulcanizer (Olivine BPS 4936-3, manufactured by Toyo Ink Manufacturing Co., Ltd.) | 3 parts by weight |
| Methyl ethyl ketone | 500 parts by weight |

For the adhesive layers, the low tackiness as measured under the following conditions was as given in the following Table D1.

(Measuring Conditions for Low Tackiness)

A coating liquid for an adhesive layer was coated in a width of one inch on a substrate (a 6 μm-thick easy-bond polyethylene terephthalate film), and the coated surface and a postal card were put on top of the other, and a load of 20 g/cm$^2$ was applied to the laminate for one min.

180° peeling (peel rate=20 cm/min) of the substrate was carried out at 25° C. using Tensilon (manufactured by Orientec Co. Ltd.).

Then, different resin coating liquids, for an interposing layer, having the following respective compositions were coated by gravure coating on the adhesive layer, and the coatings were dried (coverage on a dry basis: 2 g/m$^2$) to form interposing layers, thereby preparing transfer sheets for an adhesive layer according to the present invention (samples 1 to 7).

| (Composition of coating resin liquid A for interposing layer) | |
|---|---|
| Vinyl chloride/vinyl acetate copolymer (1000 ALK, manufactured by Denki Kagaku Kogyo K.K.) | 100 parts by weight |
| Methyl ethyl ketone | 500 parts by weight |
| (Composition of coating resin liquid B for interposing layer) | |
| Acrylic resin (BR-85, manufactured by Mitsubishi Rayon Co., Ltd.) | 100 parts by weight |
| Methyl ethyl ketone | 500 parts by weight |
| (Composition of coating resin liquid C for interposing layer) | |
| Polyester resin (Vylon 200, manufactured by Toyobo Co., Ltd.) | 100 parts by weight |
| Methyl ethyl ketone | 500 parts by weight |
| (Composition of coating resin liquid D for interposing layer) | |
| Polyurethane resin (Crisvon 3454, manufactured by Dainippon Ink and Chemicals, Inc.) | 100 parts by weight |
| Methyl ethyl ketone | 500 parts by weight |

Preparation of Transfer Sheets for Adhesive Layer (Comparative Samples 1 to 4)

For comparison, transfer sheets, for an adhesive layer, provided with an adhesive layer (comparative samples 1 and 2) were prepared in the same manner as described above in connection with the preparation of the sample 4, except that coating liquids, for an adhesive layer, having the following respective compositions were used as the coating liquid for an adhesive layer.

| (Composition of coating liquid D for adhesive layer) | |
|---|---|
| Acrylic resin (BR-93, manufactured by Mitsubishi Rayon Co., Ltd.) | 100 parts by weight |
| Methyl ethyl ketone | 500 parts by weight |
| (Composition of coating liquid E for adhesive layer) | |
| Acrylic emulsion (AE331, manufactured by Japan Synthetic Rubber Co., Ltd.) | 100 parts by weight |
| Pure water | 500 parts by weight |

For the adhesive layers, the low tackiness as measured under the above conditions was as given in the following Table D1.

For comparison, an adhesive layer was formed in the same manner as described above in connection with the preparation of the comparative sample 2, and a peelable resin (S-lec KW-1, manufactured by Sekisui Chemical Co., Ltd.) or a resin having a low glass transition point (AE 322, manufactured by Japan Synthetic Rubber Co., Ltd.) was used to form an interposing layer on the adhesive layer, thereby preparing transfer sheets for an adhesive layer (comparative samples 3 and 4).

Thereafter, a thermal sublimation transfer sheet was used to form an image on the image-receptive layer in the intermediate transfer medium sheet, and an adhesive layer was transferred thereon using the above transfer sheets for an adhesive layer (samples 1 to 7 and comparative samples 1 to 4) under the following transfer conditions to prepare intermediate image-forming objects.

(Transfer Conditions)

Thermal head: 6 dots/mm

Thermal energy: 1.0 mJ/dot

The image-receptive layer and the peelable protective layer were then transferred through the transferred and formed adhesive layer onto a postal card as an image-forming object under the following transfer conditions to prepare objects with an image formed thereon. In this case, at the time of the transfer, separation occurred between the peelable protective layer and the substrate sheet in the intermediate transfer medium sheet.

(Transfer Conditions)

Thermal head: 6 dots/mm

Thermal energy: 1.4 mJ/dot

In the above formation of an image, the registration for transfer of the image-receptive layer, the adhesion of the image to the postal card, and the quality of the formed image were evaluated by the following methods. The results are summarized in the following Table D1.

(Registrability for Transfer)

The transfer sheet for an adhesive layer and the surface of the image-receptive layer in the intermediate transfer medium sheet were put on top of the other for registration. Further, the surface of the adhesive layer transferred onto the intermediate transfer medium sheet and a postal card were put on top of the other for registration. Thereafter, a load of 20 g/cm$^2$ was applied for one min, and the transfer sheet for an adhesive layer or the postal card were held perpendicularly to examine whether or not the intermediate transfer medium sheet peeled.

Evaluation Criteria (i)

○: The intermediate transfer medium sheet did not peel.

X: The intermediate transfer medium sheet peeled.

When the intermediate transfer medium sheet did not peel in the above test, it was separated by hand and investigated for the presence of residual adhesive layer on the intermediate transfer medium sheet or the surface of the postal card.

Evaluation Criteria (ii)

○: No residual adhesive layer occurred.

X: Residual adhesive layer occurred.

(Adhesion)

A pressure-sensitive adhesive tape (Cello-Tape 545, manufactured by Nichiban Co., Ltd.) having a width of 12 mm was adhered to the image, and 180° peeling was then carried out at a peel rate of 100 cm/sec to evaluate the adhesion.

Evaluation Criteria

○: The pressure-sensitive adhesive tape alone was separated, or alternatively the image-receptive layer and the interposing layer, together with pressure-sensitive adhesive tape, were taken away, resulting in ruined surface of the card.

X: Separation occurred between the image-receptive layer and the interposing layer.

(Image Quality)

The image quality was evaluated by visual inspection.

Evaluation Criteria

○: The surface of the image was smooth, and no fiber texture of the card was observed in the image per se.

X: The influence of fiber texture of the card appeared in the image, and the creation of a streak pattern having a higher density than the area around the pattern or a streak pattern having a lower density than the area around pattern was observed.

TABLE D1

| Transfer sheet for adhesive layer | Low tackiness of adhesive layer (gf/in.) | Coating liquid/ resin for interposing layer | Registrability* | Adhesion | Image quality |
|---|---|---|---|---|---|
| Sample 1 | 7 | — | ○ | ○ | ○ |
| Sample 2 | 20 | — | ○ | ○ | ○ |
| Sample 3 | 120 | — | ○ | ○ | ○ |
| Sample 4 | 20 | A | ○ | ○ | ◎ |
| Sample 5 | 20 | B | ○ | ○ | ◎ |
| Sample 6 | 20 | D | ○ | ○ | ◎ |
| Sample 7 | 20 | D | ○ | ○ | ◎ |
| Comparative sample 1 | 3 | A | X — | ○ | ○ |
| Comparative sample 2 | 200 | A | ○ X | ○ | ○ |
| Comparative sample 3 | 20 | Peelable resin | ○ | X | ○ |
| Comparative sample 4 | 20 | Low Tg resin | ○ | ○ | X |

*The samples 1 to 7 and the comparative samples 3 and 4 were evaluated as ○ for both the evaluation items (i) and (ii). For the comparative samples 1 and 2, the results of evaluation for the item (i) are indicated on the left column, while the results of evaluation for the item (ii) are indicated on the right column.

As is apparent from Table D1, the samples 1 to 7 provided with an adhesive layer having a low tackiness in the range of from 5 to 150 gf/in. had excellent registrability, and it was confirmed that the formation of an interposing layer on the adhesive layer (samples 4 to 7) resulted in improved image quality.

EXAMPLE D2

Preparation of Transfer Sheets for Adhesive Layer (Samples 1 to 4)

A 6 μm-thick polyethylene terephthalate film (Lumirror, manufactured by Toray Industries, Inc.) with a back surface layer coated thereon was provided as a substrate sheet. A coating liquid, for a peel layer, having the following composition was coated by gravure coating on the untreated surface of the substrate sheet, and the coating was dried (coverage on a dry basis: 1 g/m$^2$) to form a peel layer. The glass transition point of the peel layer was 65° C.

| (Composition of coating liquid for peel layer) | |
|---|---|
| Vinyl chloride/vinyl acetate copolymer (Tg = 65° C.) (1000A, manufactured by Denki Kagaku Kogyo K.K.) | 100 parts by weight |
| Methyl ethyl ketone | 500 parts by weight |

The coating liquid A, for an adhesive layer, used in Example D1 was coated by gravure coating on the peel layer, and the coating was dried (coverage on a dry basis 3 g/m$^2$) to form an adhesive layer, having low tackiness (glass transition point: −58° C.), thereby preparing a transfer sheet for an adhesive layer according to the present invention (sample 1).

A transfer sheet for an adhesive layer according to the present invention (sample 2) was prepared in the same manner as described above in connection with the preparation of the sample 1, except that a coating liquid having the following composition was used as the coating liquid for a peel layer, thereby forming a peel layer (glass transition point: 65° C.).

| (Composition of coating liquid for peel layer) | |
|---|---|
| Vinyl chloride/vinyl acetate copolymer (Tg = 65° C.) (1000 ALK, manufactured by Denki Kagaku Kogyo K.K.) | 100 parts by weight |
| Methyl ethyl ketone | 500 parts by weight |

A transfer sheet for an adhesive layer according to the present invention (sample 3) was prepared in the same manner as described above in connection with the preparation of the sample 1, except that a coating liquid having the following composition was used as the coating liquid for a peel layer, thereby forming a peel layer (glass transition point: 105° C.).

| (Composition of coating liquid for peel layer) | |
|---|---|
| Acrylic resin (Tg: 105° C.) (BR-85, manufactured by Mitsubishi Rayon Co., Ltd.) | 100 parts by weight |
| Methyl ethyl ketone | 500 parts by weight |

A transfer sheet for an adhesive layer according to the present invention (sample 4) was prepared in the same manner as described above in connection with the preparation of the sample 1, except that a coating liquid having the following composition was used as the coating liquid for a peel layer, thereby forming a peel layer (glass transition point: 75° C.).

| (Composition of coating liquid for peel layer) | |
|---|---|
| Polyester resin (Tg: 75° C.) (UE 3600, manufactured by Unitika Ltd.) | 100 parts by weight |
| Methyl ethyl ketone | 500 parts by weight |

Preparation of Transfer Sheets for Adhesive Layer (Comparative Samples 1 to 3)

For comparison, transfer sheets, for an adhesive layer, provided with a peel layer and an adhesive layer (comparative samples 1 and 2) were prepared in the same manner as described above in connection with the preparation of the sample 1, except that neither coating liquid D nor coating liquid E, for an adhesive layer used in Example D1 was used.

Further, for comparison, a transfer sheet, for an adhesive layer, provided with an adhesive layer having no low tackiness (comparative sample 3) was prepared in the same manner as described above in connection with the preparation of the comparative sample 1, except that no peel layer was formed.

Thereafter, the procedure of Example D1 was repeated to form an image on an image-receptive layer of the postal card in an intermediate transfer medium sheet using a thermal sublimation transfer sheet.

Further, the transfer sheets for an adhesive layer (samples 1 to 4 and comparative samples 1 to 3) prepared above were used to transfer the peel layer and the adhesive layer on a postal card as an image-forming object under the following transfer conditions.

(Transfer Conditions)

Thermal head: 6 dots/mm

Thermal energy: 1.2 mJ/dot

Thereafter, the image-receptive layer in the intermediate transfer medium sheet was put on top of the adhesive layer or the peel layer of the postal card in order to perform registration, and the image-receptive layer and the releasable protective layer in the intermediate transfer medium sheet were then transferred under the above transfer conditions to prepare an object with an image formed thereon. In the transfer, separation occurred between the peelable protective layer and the substrate sheet in the intermediate transfer medium sheet.

and the surface of the image-receptive layer in the intermediate transfer medium sheet were put on top of the other for registration. Thereafter, a load of 20 g/cm$^2$ was applied for one min, and the postal card were held perpendicularly to examine whether or not the transfer sheet for an adhesive layer or the intermediate transfer medium sheet peeled.

Evaluation Criteria (i)

○: The transfer sheet for an adhesive layer and the intermediate transfer medium sheet did not peel.

X: The transfer sheet for an adhesive layer and the intermediate transfer medium sheet peeled.

When the transfer sheet for an adhesive layer and the intermediate transfer medium sheet did not peel, they were separated by hand and investigated for the presence of residual adhesive layer on the surface of the postal card.

Evaluation Criteria (ii)

○: No residual adhesive layer occurred.

X: Residual adhesive layer occurred.

(Adhesion)

A pressure-sensitive adhesive tape (Cello-Tape 545, manufactured by Nichiban Co., Ltd.) having a width of 12 mm was adhered to the image, and 180° peeling was then carried out at a peel rate of 100 cm/sec to evaluate the adhesion.

Evaluation Criteria

○: The pressure-sensitive adhesive tape alone was separated, or alternatively the image-receptive layer and the adhesive layer, together with pressure-sensitive adhesive tape, were taken away, resulting in ruined surface of the card.

X: Separation occurred between the image-receptive layer and the peel layer.

TABLE D2

| Transfer sheet for adhesive layer | Low tackiness of adhesive layer (gf/in.) | Glass transition point of peel layer | Registrability* | Adhesion | Image quality |
|---|---|---|---|---|---|
| Sample 1 | 7 | 65° C. | ○ | ○ | ○ |
| Sample 2 | 20 | 65° C. | ○ | ○ | ○ |
| Sample 3 | 20 | 105° C. | ○ | ○ | ○ |
| Sample 4 | 120 | 75° C. | ○ | ○ | ○ |
| Comparative sample 1 | 3 | 65° C. | X — | ○ | ○ |
| Comparative sample 2 | 200 | 65° C. | ○ X | ○ | ○ |
| Comparative sample 3 | 20 | — | ○ | ○ | X |

*The samples 1 to 4 and the comparative sample 3 were evaluated as ○ for both the evaluation items (i) and (ii). For the comparative samples 1 and 2, the results of evaluation for the item (i) are indicated on the left column, while the results of evaluation for the item (ii) are indicated on the right column.

In the above formation of an image, the registration for transfer of the image-receptive layer, the adhesion of the image to the postal card, and the quality of the formed image were evaluated by the following methods. The results are summarized in the following Table D2. The registrability for transfer and the adhesion were evaluated by the following methods, and the image quality was evaluated in the same manner as in Example D1.

(Registrability for Transfer)

The transfer sheet for an adhesive layer and a postal card were put on top of the other for registration, Further, the surface of the adhesive layer transferred onto the postal card As can be seen from Table D2, it was confirmed that the transfer sheets for an adhesive layer according to the present invention (samples 1 to 4) were excellent in registrability, as well as in adhesion and image quality.

As is apparent from the foregoing detailed description, according to the present invention, an adhesive layer having low tackiness is separably provided onto a substrate sheet. Therefore, in the registration between an intermediate image-forming object, comprising the adhesive layer transferred onto an intermediate transfer medium, as a transfer material, with an image formed thereon, and an image-forming object, or between an intermediate image-forming object, comprising the adhesive layer transferred onto an image-forming object as an object, on which an image is to be formed thereon, and an intermediate transfer medium with an image formed thereon, after both the media are brought into contact with each other, they may be separated from and re-adhered to each other, rendering the registration very easy and, at the same time, resulting in markedly reduced unsatisfactory registration. Further, when an interposing layer is formed on the adhesive layer, the adhesive layer is transferred onto a transfer material (for example, an intermediate transfer medium) through the interposing layer. Therefore, when necessary properties, such as adhesion to the transfer material (intermediate transfer medium) and a capability of preventing bleeding of dyes, are imparted to the interposing layer, properties required of the adhesive layer can be limited to such properties as low tackiness, adhesion to an image-forming object or the like and a capability of preventing penetration, increasing the degree of freedom for the selection of material for the adhesive layer. Further, when a peel layer is provided between the substrate sheet and the adhesive layer, good separation occurs between the substrate sheet and the peel layer, resulting in transfer of the adhesive layer, together with the peel layer, onto an object (for example, an image-forming object). Further, in this case, after transfer, the peel layer is located on the transferred adhesive layer, ensuring good surface properties. Further, an object, with an image formed thereon, prepared by the image-forming method according to the present invention is free from bleeding in the formed image, and the formed image is smooth independently of the surface properties of the image-forming object.

EXAMPLE E

Preparation of Transfer Sheets for Adhesive Layer (Samples 1 to 4)

A 6 μm-thick polyethylene terephthalate film (Lumirror, manufactured by Toray Industries, Inc.) with a back surface layer coated thereon was provided as a substrate sheet. A coating liquid, for an adhesive layer, having the following composition was coated by gravure coating on the substrate sheet, and the coating was dried (coverage on a dry basis: 3 g/m$^2$) to form an adhesive layer.

| (Composition of coating liquid for adhesive layer) | |
|---|---|
| Polyamide resin (Tg: 50° C.) (Macromelt 6240, manufactured by Henkel Hakusui Corp.) | 100 parts by weight |
| Methyl ethyl ketone | 500 parts by weight |

Thereafter, a thermal sublimation transfer sheet was used to form an image on an image-receptive layer in an intermediate transfer medium sheet, and an adhesive layer was transferred thereon using the above transfer sheets for an adhesive layer under the following transfer conditions.

(Transfer Conditions)

Thermal head: 6 dots/mm

Thermal energy: 1.0 mJ/dot

The image-receptive layer with an image formed thereon was transferred through the transferred adhesive layer onto image-forming objects (a polyvinyl chloride card, a PET card, a coated paper, and a wood-free paper) under the above transfer conditions to prepare objects with an image formed thereon.

For comparison, an image-receptive layer with an image formed thereon was transferred directly onto the image-forming objects without through the adhesive layer under the above transfer conditions, thereby preparing objects with an image formed thereon.

For the images thus obtained, the adhesion and the image quality were evaluated by the following method. The results are given in the following Table E1.

(Adhesion)

A pressure-sensitive adhesive tape (Cello-Tape 545, manufactured by Nichiban Co., Ltd.) having a width of 12 mm was adhered to the image, and 180° peeling was then carried out at a peel rate of 100 cm/sec to evaluate the adhesion.

Evaluation Criteria

○: The image-receptive layer was not separated from the image-forming object, and the pressure-sensitive adhesive tape alone was separated, or alternatively the image-receptive layer and the adhesive layer, together with the pressure-sensitive adhesive tape, were taken away, resulting in ruined surface of the image-forming object.

Δ: Part of the image-receptive layer in the area where the pressure-sensitive adhesive tape had been adhered was separated from the image-forming object without ruin of the surface of the image-forming object.

X: The whole image-receptive layer in the area where the pressure-sensitive adhesive tape had been adhered was separated from the image-forming object without ruin of the surface of the image-forming object.

TABLE E1

| | Ex. | Comp. Ex. |
|---|---|---|
| Polyvinyl chloride card | ○ | ○ |
| PET card | ○ | Δ |
| Coated paper | ○ | Δ |
| Wood-free paper | ○ | X |

What is claimed is:

1. An article with an image formed thereon, comprising:

an image-receiving object;

an adhesive layer and an interposing layer formed in this order on a predetermined site of the image-receiving article; and an image-receptive layer provided on the interposing layer, the image-receptive layer having on the surface adjacent the interposing layer an image formed by a thermal sublimation transfer process, wherein the interposing layer has a glass transition point in the range of from 50 to 115° C. and the adhesive layer has a glass transition point in the range of from 35 to 100° C., the glass transition point of the interposing layer being above that of the adhesive layer.

2. The article with an image formed thereon according to claim 1, wherein at least one of the interposing layer and the adhesive layer contains a filler.

3. An article with an image formed thereon, comprising:

an image-receiving object;

an adhesive layer and a peel layer formed in this order on a desired site of the image-receiving object; and an image-receptive layer provided on the peel layer, the image-receptive layer having thereon an image formed by a thermal sublimation transfer process.

4. The article with an image formed thereon according to claim 3, wherein the peel layer has a glass transition point in the range of from 50 to 115° C. and the adhesive layer has a glass transition point in the range of from 35 to 100° C.

5. The article with an image formed thereon according to claim 3, wherein at least one of the peel layer and the adhesive layer contains a filler.

6. The object with an image formed thereon according to claim 3, wherein the glass transition point of the peel layer is above that of the adhesive layer.

7. An object with an image formed thereon, comprising:

an image-receiving object;

an adhesive layer provided on a desired area of the image-receiving object;

an image-receptive layer provided on the adhesive layer, the image-receptive layer having an image formed by a thermal sublimation transfer process; and a peel layer between the image-receptive layer and the adhesive layer, the glass transition point of the peel layer being above that of the adhesive layer.

* * * * *

UNITED STATES PATENT AND TRADEMARK OFFICE

CERTIFICATE OF CORRECTION

PATENT NO. : 6,730,633 B2
DATED : May 4, 2004
INVENTOR(S) : Takeshi Ueno et al.

It is certified that error appears in the above-identified patent and that said Letters Patent is hereby corrected as shown below:

Title page,
Item [63], Related U.S. Application Data, change "Pat. No. 6,350,580" to -- Pat. No. 6,350,508 --.

Signed and Sealed this

Sixth Day of July, 2004

JON W. DUDAS
*Acting Director of the United States Patent and Trademark Office*